US008056799B2

(12) United States Patent
Burke et al.

(10) Patent No.: US 8,056,799 B2
(45) **Date of Patent: *Nov. 15, 2011**

(54) CONTAINER HAVING TAB IDENTIFIERS AND METHOD FOR CONSTRUCTING THE SAME

(75) Inventors: Bradley John Burke, Elmhurst, IL (US); Rachel K. Mortenson, Elmhurst, IL (US)

(73) Assignee: Graphic Packaging International, Inc., Marietta, GA (US)

( * ) Notice: Subject to any disclaimer, the term of this patent is extended or adjusted under 35 U.S.C. 154(b) by 1085 days.

This patent is subject to a terminal disclaimer.

(21) Appl. No.: 11/419,296

(22) Filed: May 19, 2006

(65) Prior Publication Data

US 2007/0267468 A1 Nov. 22, 2007

(51) Int. Cl.
*B65D 5/00* (2006.01)

(52) U.S. Cl. ..... 229/146; 229/114; 206/459.5

(58) Field of Classification Search ..... 229/146, 229/902, 906, 74; 206/803
See application file for complete search history.

(56) References Cited

U.S. PATENT DOCUMENTS 1,048,577 A * 12/1912 Pardoe ..... 40/359
2,054,596 A 9/1936 Ford
2,180,808 A 11/1939 Jacobstein et al.
2,194,220 A 3/1940 Elder
2,877,736 A 3/1959 Simmons
3,071,882 A 1/1963 Eisman et al.
3,099,381 A 7/1963 Meyers
3,205,603 A 9/1965 Brumley
3,958,744 A 5/1976 Herglotz
4,004,691 A * 1/1977 Wihksne ..... 206/459.1
4,472,896 A 9/1984 Brauner et al.
4,630,733 A 12/1986 Fear
4,684,023 A 8/1987 Cortopassi
4,901,457 A 2/1990 Chandler
D320,743 S 10/1991 Alexander et al.
5,058,803 A 10/1991 Gulliver
RE33,979 E * 6/1992 Cortopassi ..... 206/459.1
D342,446 S 12/1993 Parker et al.
D346,552 S 5/1994 Krupa
D365,272 S 12/1995 Krupa et al.
5,662,265 A 9/1997 Jensen
(Continued)

OTHER PUBLICATIONS

Notice of Allowance and Fee(s) Due for U.S. Appl. No. 11/682,399, filed: Mar. 6, 2007; in re: Burke, entitled Container Having Tab Identifiers and Method for Constructing the Same.

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A container for packaging a product is provided. The container includes a blank of sheet material including a first panel, and at least one tab identifier defined within the first panel and moveable with respect to the first panel. The at least one tab identifier is configured to cooperate with a flex member assembly defined at least partially within the first panel. The blank forms the container including a tray portion and a lid portion coupled along a fold line to the tray portion. The lid portion is moveable about the fold line with respect to the tray portion between an open configuration and a closed configuration. In the closed configuration, the tray portion and the lid portion define a volume for storing the product.

15 Claims, 17 Drawing Sheets

U.S. PATENT DOCUMENTS

| | | | | |
|---|---|---|---|---|
| 5,690,273 | A | 11/1997 | Jensen | |
| 5,697,549 | A | 12/1997 | Yocum | |
| 5,826,781 | A | 10/1998 | Jensen | |
| 6,027,018 | A * | 2/2000 | Yocum | 229/400 |
| 6,041,997 | A | 3/2000 | Jensen | |
| 6,068,181 | A | 5/2000 | Cai | |
| D458,127 | S | 6/2002 | de Groote | |
| D460,691 | S | 7/2002 | Morris et al. | |
| D467,499 | S | 12/2002 | Garza et al. | |
| D473,787 | S | 4/2003 | Jones, Jr. et al. | |
| D484,043 | S | 12/2003 | Hwang et al. | |
| 6,681,983 | B2 | 1/2004 | Bill-Moore | |
| 2003/0047595 | A1 | 3/2003 | Bill-Moore | |
| 2004/0074953 | A1 * | 4/2004 | Yocum | 229/114 |
| 2007/0267467 | A1 | 11/2007 | Burke et al. | |

* cited by examiner

CONTAINER HAVING TAB IDENTIFIERS AND METHOD FOR CONSTRUCTING THE SAME

BACKGROUND OF THE INVENTION

This invention relates generally to containers and, more particularly, to a container having tab identifiers and a method for constructing the container.

Containers are oftentimes used for packaging, storing and/or transporting a product, such as food. At least some known containers are clamshell type containers fashioned from a unitary blank of paperboard and are used by the fast food industry. These clamshell type containers are typically used by first placing a sandwich or other food product into a lower or tray portion of the clamshell container, closing an upper or lid portion of the container, and providing the container with the food to a consumer. The container is typically releasably latched and is thereafter unlatched by the consumer to gain access to the product.

In this type of container, as well as in other types of containers particularly adapted for the fast food industry, there exists a need to identify the food product stored within the container so the assembler of the food product and/or package may readily designate the contents of the container to thereby inform any intermediate server and/or the consumer of the contents. In some cases, a server will identify the product stored within the container by marking the container with a writing utensil or using an adhesive label. Such current product identifiers are difficult to use and/or routinely lack description.

BRIEF DESCRIPTION OF THE INVENTION

In one aspect, a container for packaging a product is provided. The container includes a blank of sheet material including a first panel, and at least one tab identifier defined within the first panel and moveable with respect to the first panel. The at least one tab identifier is configured to cooperate with a flex member assembly defined at least partially within the first panel. The blank forms the container including a tray portion and a lid portion coupled along a fold line to the tray portion. The lid portion is moveable about the fold line with respect to the tray portion between an open configuration and a closed configuration. In the closed configuration, the tray portion and the lid portion define a volume for storing the product.

In another aspect, a container for packaging a product is provided. The container includes a tray portion and a lid portion movably coupled to the tray portion along a first fold line. The lid portion is moveable about the first fold line with respect to the tray portion between an open configuration and a closed configuration. In the closed configuration, the tray portion and the lid portion define a volume for storing the product. The container further includes a flex member assembly at least partially defined within a first panel of the lid portion. The flex member assembly includes a first member and an opposing second member defining a slot extending therebetween. The container further includes a tab identifier coupled to the lid portion. The tab identifier is moveable about a second fold line and positionable within the slot.

In a further aspect, a container for packaging a product is provided. The container includes a tray portion and a lid portion movably coupled to the tray portion along a first fold line. The lid portion is moveable about the first fold line with respect to the tray portion between an open configuration and a closed configuration. In the closed configuration, the tray portion and the lid portion define a volume for storing the product. The container further includes a tab identifier defined within a first panel of the lid portion and moveable about a fold line to provide an opening through which a portion of a second panel coupled to the first panel is visible.

In a further aspect, a method for identifying a product is provided. The method includes constructing a container having a tray portion and a lid portion coupled to the tray portion along a first fold line, a flex member assembly defined within the lid portion, and at least one tab identifier defined within the lid portion. The tab identifier is rotated from an initial position into a display position. The tab identifier is engaged within the flex member assembly at the display position.

DETAILED DESCRIPTION OF THE INVENTION

The present invention is described below in reference to its application in connection with and operation of a container including a tab identifier. However, it will be apparent to those skilled in the art and guided by the teachings herein provided that the invention is likewise applicable to any suitable storage and/or display container including, without limitation, a carton, a tray or a box.

In one embodiment, the container is fabricated from a paperboard material. The container, however, may be fabricated using any suitable material, and therefore is not limited to a specific type of material. In alternative embodiments, the container is fabricated using cardboard, corrugated board, plastic and/or any suitable material known to those skilled in the art and guided by the teachings herein provided.

In a particular embodiment, the container includes a marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. The container may have any suitable size, shape and/or configuration, i.e. number of sides, whether such sizes, shapes and/or configurations are described and/or illustrated herein. For example, in one embodiment, the container includes a shape that provides functionality, such as a shape that facilitates transporting the container and/or a shape that facilitates stacking and/or arrangement of a plurality of containers.

Figure 1:
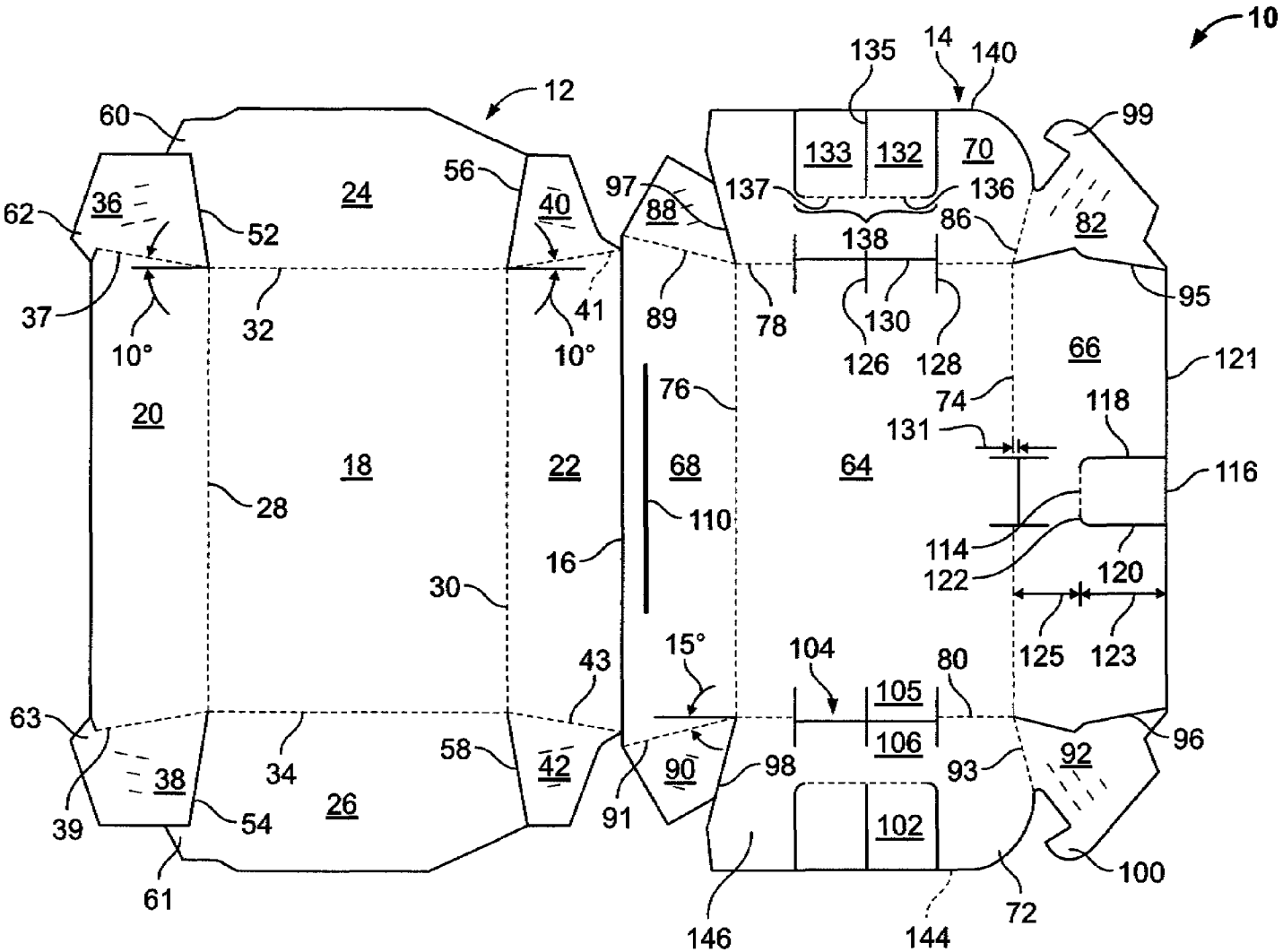
FIG. 1 is a top plan view of a blank of sheet material for constructing a container according to one embodiment.
Figure 2:
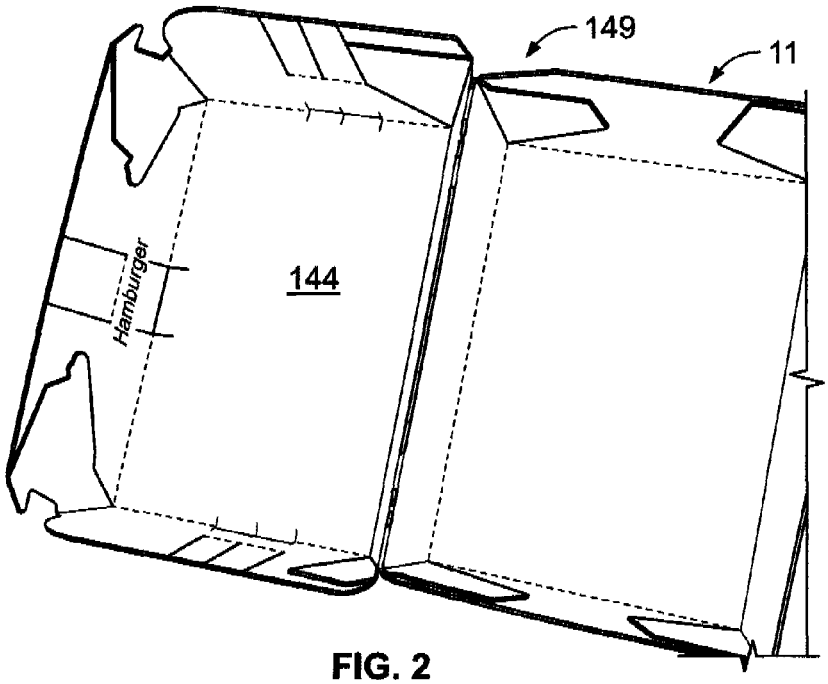
FIG. 2 is a perspective view of a container in an open configuration constructed from the blank shown in FIG. 1.
Figure 3:
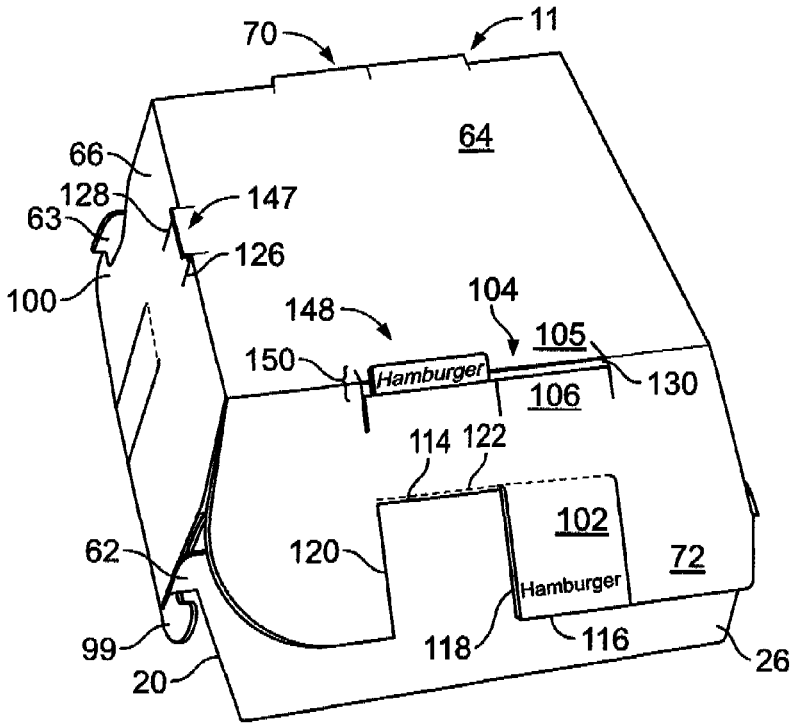
FIG. 3 is a perspective view of a container in a closed configuration constructed from the blank shown in FIG. 1.

FIGS. 1, 2, and 3 illustrate the formation of one embodiment of a container. Specifically, FIG. 1 is a top plan view of one embodiment of a blank of sheet material designated in its entirety by element reference number 10. FIG. 2 is a perspective view of a container in an open configuration designated in its entirety by element reference number 11 constructed from blank 10 shown in FIG. 1. FIG. 3 is a perspective view of container 11 in a closed configuration constructed from blank 10 shown in FIG. 1.

Referring to FIG. 1, blank 10 is configured to form a clamshell container 11 including at least one tab identifier including indicia that identifies the contents within container 11. In one embodiment, blank 10 is made of paperboard. In an alternative embodiment, blank 10 is made of cardboard, corrugated board, plastic and/or any suitable material.

Blank 10 includes a tray portion 12 and a lid portion 14. Tray portion 12 is hingedly coupled to lid portion 14 along fold line 16 extending between tray portion 12 and lid portion 14. In one embodiment, fold line 16 includes a line of separation, such as a die cut, defined along a portion of fold line 16. As shown in FIG. 1, tray portion 12 includes a support or bottom panel 18, a first or front end panel 20, an opposing second or rear end panel 22, a first side panel 24, and an opposing second side panel 26. Front end panel 20 and rear end panel 22 are coupled to bottom panel 18 by preformed, generally parallel, fold lines 28 and 30, respectively. First side panel 24 and second side panel 26 are coupled to bottom panel 18 by preformed, generally parallel, fold lines 32 and 34, respectively. It is apparent to those skilled in the art and guided by the teachings herein provided that fold lines 28, 30, 32, 34, as well as other fold lines described herein, may include any suitable line of weakening known to those skilled in the art and guided by the teachings herein provided.

As shown in FIG. 1, a first side flap 36 extends from front end panel 20 along a fold line 37, and an opposing second side flap 38 extends from front end panel 20 along a fold line 39. Similarly, a third side flap 40 extends from rear end panel 22 along a fold line 41, and an opposing fourth side flap 42 extends from rear end panel 22 along a fold line 43. In one embodiment, fold lines 37, 41 extend outwardly with respect to bottom panel 18 at an angle of about ten degrees with respect to fold line 32. In one embodiment, fold lines 39, 43 extend outwardly with respect to bottom panel 18 at an angle of about ten degrees with respect to fold line 34. In this embodiment, blank 10 defines a suitable line of separation 52 between first side flap 36 and first side panel 24 and a suitable line of separation 54 between second side flap 38, and second side panel 26 for facilitating folding front end panel 20 with respect to bottom panel 18 to form a portion of tray portion 12. Similarly, a suitable line of separation 56 is defined between third side flap 40 and first side panel 24, and a suitable line of separation 58 is defined between fourth side flap 42 and second side panel 26 for facilitating folding rear end panel 22 with respect to bottom panel 18 to form a portion of tray portion 12.

In one embodiment, first side panel 24 includes an angular tab 60 configured to engage lid portion 14, as described in greater detail below. Second side panel 26 includes an angular tab 61 configured to engage lid portion 14. In a particular embodiment, first flap 36 includes a flange 62 configured to correspond or align with tab 60 and/or second flap 38 includes a flange 63 configured to correspond or align with tab 61.

As shown in FIG. 1, lid portion 14 includes a support or top panel 64, a first or front end panel 66 and an opposing second or rear end panel 68, and a first side panel 70 and an opposing second side panel 72. Front end panel 66 and rear end panel 68 are coupled to top panel 64 by preformed, generally parallel, fold lines 74 and 76, respectively. First side panel 70 and second side panel 72 are coupled to top panel 64 by preformed, generally parallel, fold lines 78 and 80, respectively. It is apparent to those skilled in the art and guided by the teachings herein provided that fold lines 74, 76, 78, 80 may include any suitable line of weakening known to those skilled in the art and guided by the teachings herein provided.

As shown in FIG. 1, a first side flap 82 extends from first side panel 70 along a fold line 86. A second side flap 88 extends from rear end panel 68 along a fold line 89 and an opposing third side flap 90 extends from rear end panel 68 along a fold line 91. In one embodiment, fold line 89 extends outwardly with respect to top panel 64 at an angle of about fifteen degrees with respect to fold line 78. In one embodiment, fold line 91 extends outwardly with respect to top panel 64 at an angle of about fifteen degrees with respect to fold line 80. A fourth side flap 92 extends from second side panel 72 along a fold line 93. In this embodiment, blank 10 defines a suitable line of separation 95 between front end panel 66 and first side flap 82 and a suitable line of separation 96 between front end panel 66 and fourth side flap 92 for facilitating folding front end panel 66 with respect to top panel 64 to form a portion of lid portion 14. Further, blank 10 defines a suitable line of separation 97 between second side flap 88 and first side panel 70 for facilitating folding first side panel 70 with respect to top panel 64 to form a portion of lid portion 14 and a suitable line of separation 98 between third side flap 90 and second side panel 72 for facilitating folding second side panel 72 with respect to top panel 64 to form a portion of lid portion 14.

In one embodiment, first side flap 82 includes an angular flange 99 and fourth side flap 92 includes an angular flange 100 each configured to engage corresponding flange 62 and corresponding flange 63, respectively, to retain container 11 in the closed configuration as described in greater detail below. In a particular embodiment, rear end panel 68 defines a slot 110 substantially parallel to fold line 116 extending at least partially along a length of rear end panel 68. Slot 110 works with fold line 116 to facilitate opening and closing of container 11.

In one embodiment, lid portion 14 includes at least one tab identifier 102 configured to identify and/or describe the contents within container 11 constructed from blank 10. As shown in FIG. 1, lid portion 14 includes a plurality of tab identifiers 102 that are configured to engage a corresponding flex member assemblies 104 such that each flex member assembly 104 includes opposing flex members 105 and 106. At least one tab identifier 102 is defined within front end panel 66, rear end panel 68, side panel 70 and/or side panel 72 of lid portion 14. In one embodiment, each tab identifier 102 includes a top edge 114, an opposing bottom edge 116 and opposing side edges 118, 120 extending between top edge 114 and bottom edge 116. In a particular embodiment, tab identifiers 102 are generally rectangular in shape such that edges 118 and 120 are substantially parallel, and edges 114 and 116 are substantially parallel. In a particular embodiment, bottom edge 116 is defined along an edge 121 of front end panel 66, as shown in FIG. 1. Tab identifier 102 is coupled to front end panel 66 at top edge 114 along a fold line 122. Suitable lines of separation, such as perforated lines, are defined along edges 118, 120. Tab identifiers 102 extend between edges 114 and 116 defining a distance 123. Edge 114 is positioned with respect to fold line 74 at a distance 125. In this embodiment, distance 123 is greater than distance 125.

Tab identifiers 102 are generally used to identify the contents placed or stored within container 11. Each tab identifier 102 is moveable about fold line 122 defined along top edge 114 such as by rotating or pivoting tab identifier 102 about fold line 122. In one embodiment, fold line 122 is substantially parallel to fold line 74. Tab identifiers 102 are configured to generally move or rotate inwardly and upwardly about edge 114 toward top panel 64. In an alternative embodiment, tab identifier 102 is configured to move outwardly and upwardly about edge 114 toward top panel 64.

In use, tab identifier 102 is moved or rotated to engage or cooperate with corresponding flex member assembly 104 at least partially defined within top panel 64. Flex member assembly 104 includes cooperating flex members 105, 106 defined by lines of separation 126, 128, 130. In one embodiment, flex member assembly 104 is generally defined along fold line 74 and is generally h-shaped, e.g., flex member assembly 104 includes two opposing, generally parallel lines of separation 126, 128 and a third line of separation or slot 130 extending therebetween and generally perpendicular to opposing lines of separation 126, 128. Lines of separation 126, 128 extend partially into top panel 64 and/or front end panel 66. In one embodiment, slot 130 includes perforations. In a particular embodiment, slot 130 is substantially collinear with fold line 74. In an alternative embodiment, as shown in FIG. 1, slot 130 is defined at a distance 131 offset with respect to fold line 74 and generally parallel to fold line 74. In this embodiment, slot 130 is substantially equal in length to bottom edge 116 of tab identifier 102.

Flex members 105, 106 flex outwardly to allow tab identifier 102 to be moved or rotated and positioned within slot 130. Flex members 105, 106 maintain tab identifier 102 in a locked or display position. In one embodiment, flex members 105, 106 engage a surface of tab identifier 102 to support and/or align tab identifier 102 in the locked or display position. Moreover, flex members 105, 106 are configured to flex outwardly to release tab identifier 102 such that tab identifier 102 may be returned to an initial position generally coplanar with front end panel 66.

In one embodiment, a plurality of tab identifiers 102 are defined within lid portion 14. As shown in FIG. 1, adjacent tab identifiers 102 may abut one another in lid portion 14. In this embodiment, a first tab identifier 132 and second tab identifier 133 share a common side edge 135 and are coupled to first side panel 70 along collinear fold lines 136 and 137 at a top edge 138. Tab identifiers 132 and 133 extend between fold lines 136 and 137, respectively, and bottom edge 140 of first side panel 70. First tab identifier 132 and second tab identifier 133 are moveable or rotatable about top edge 138 independently. In one embodiment, when more than one abutting tab identifier is defined with lid portion 14, flex member assembly 104 includes a suitable number of corresponding and cooperating flex members 105, 106 and/or slots 130.

Blank 10 includes an interior surface 144 and an exterior surface 146. Hence, each tab identifier 102 includes an interior surface 144 and an exterior surface 146. In one embodiment, each tab identifier 102 includes indicia on interior surface 144 and/or exterior surface 146 to identify the contents within container 11. In a particular embodiment, indicia is printed onto interior surface 144 and exterior surface 146. In an alternative embodiment, indicia may be applied to interior surface 144 and/or exterior surface 146, such as by adhesively affixing a label to interior surface 144 and exterior surface 146, or by drawing or writing indicia onto interior surface 144 and/or exterior surface 146. It is apparent to those skilled in the art and guided by the teachings herein provided that indicia may be applied to the container by any suitable method known to those skilled in the art and guided by the teachings herein provided. Indicia enables a user to quickly assign one of a plurality of products to a single container. Indicia also stimulates visual awareness of a user. For example, a tab identifier 102 may indicate the type of sandwich in tray portion 12 and a different tab identifier may indicate the condiments placed on the sandwich. Moreover, positioning of indicia on interior surface 144 within container 11 enables a user to identify a product order (i.e., a product to be placed within the container), when container 11 is in an open configuration 149 and ready to be loaded, as shown in FIG. 2. Indicia on exterior surface 146 further enables a user to easily determine the contents of container 11 among a plurality of other like-kind containers when the container is in the closed configuration.

FIG. 3 is a perspective view of container 11 constructed from blank 10 shown in FIG. 1. More specifically, FIG. 3 shows container 11 in a constructed and closed configuration. Generally, the panels and the flaps of blank 10 are folded along respective fold lines towards interior surface 144 of blank 10. Side panels 24, 26 are folded along fold lines 32, 34 towards bottom panel 18. End panels 20, 22 are folded inwardly along fold lines 28, 30 towards bottom panel 18. Furthermore, flaps 36, 40 are affixed to interior surface 144 of side panel 24, and flaps 38, 42 are affixed to interior surface 144 of side panel 26 using a suitable adhesive material. It is apparent to those skilled in the art and guided by the teachings herein provided that any suitable material and/or mechanism may be used to affix portions of blank 10 together to form container 11.

Flaps 82 and 92 are folded along edges 86 and 93, respectively. Flaps 88 and 90 are folded along fold lines 89 and 91, respectively. The flaps are then affixed to the interior surface of the corresponding panel. Specifically, flaps 82 and 92 are affixed to front end panel 66. Flap 88 is affixed to interior surface 144 of panel 70. Flap 90 is affixed to interior surface 144 of panel 72. In one embodiment, container 11 is moveable to a closed configuration by folding tray portion 12 and lid portion 14 toward interior surface 144 along fold line 16.

In the closed configuration, as shown in FIG. 3, panel 66 overlaps panel 20 and side panels 70, 72 overlap side panels 24, 26, respectively. Front end panel 66 releasably couples to front end panel 20. In one embodiment, flange 99 engages tab 60, and flange 100 engages tab 61 to retain container 11 in the closed configuration. It is apparent to those skilled in the art and guided by the teachings herein provided that any suitable component and/or mechanism may be used to releasably couple lid portion 14 to tray portion 12 to retain container 11 in the closed configuration.

As shown in FIG. 3, tab identifier 102 is shown in an initial position 147. In use, tab identifier 102 is rotated or moved about fold line 122. Side edge 118 and side edge 120 are defined by perforated edges for facilitating moving or rotating tab identifier 102 about fold line 122. Tab identifier 102 is rotated towards interior surface 144 to engage corresponding flex member assembly 104 within top panel 64. In one embodiment, tab identifier 102 is positioned within slot 130 defined in flex member assembly 104 and retained in a display position 148 by flex members 105 and 106.

At least a portion of tab identifier 102 extends outwardly from top panel 64 such that indicia on tab identifier 102 is visible in display position 148. When tab identifier 102 is in display position 148, flex members 105, 106 extend outwardly from lid portion 14. In this embodiment, tab identifier 102 includes indicia positioned at or near bottom edge 116 on interior surface 144 and/or exterior surface 146 of tab identifier 102. In a particular embodiment, indicia is placed on interior surface 144 of lid portion 14 near corresponding tab identifier 102 such that the indicia corresponds with contents of container 11, as shown in FIG. 2. Indicia on interior surface 144 of tab identifier 102 is visible when container 11 is in the closed configuration. Additionally, indicia positioned on exterior surface 146 of tab identifier 102 is visible from the interior of container 11 when container 11 is in open configuration 149 and tab identifier 102 is in display position 148. This allows a user to identify the product to be placed within container 11 without viewing the exterior of container 11 when container 11 is in open configuration 149.

Figure 4:
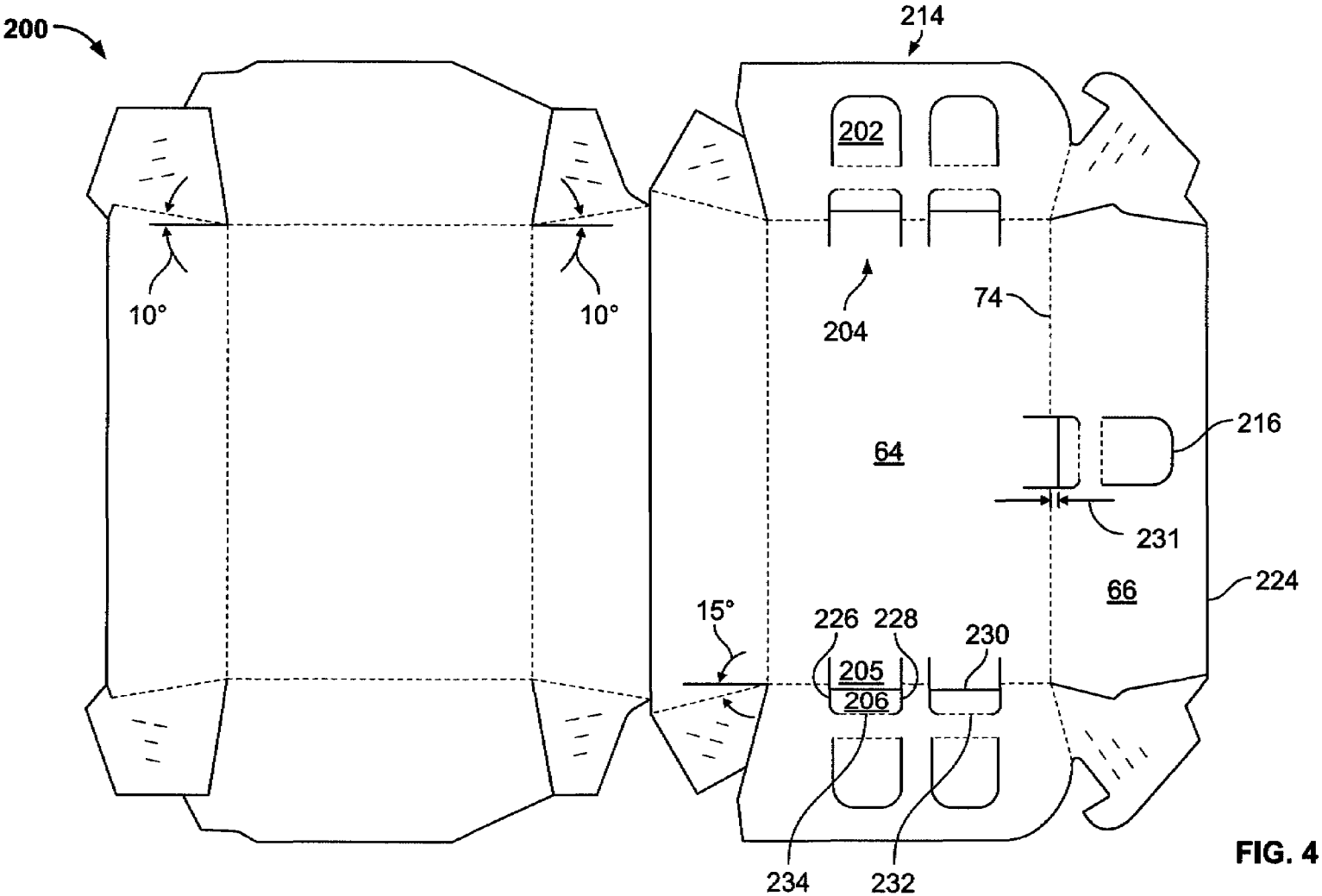
FIG. 4 is a top plan view of a blank of sheet material for constructing a container according to one embodiment.
Figure 5:
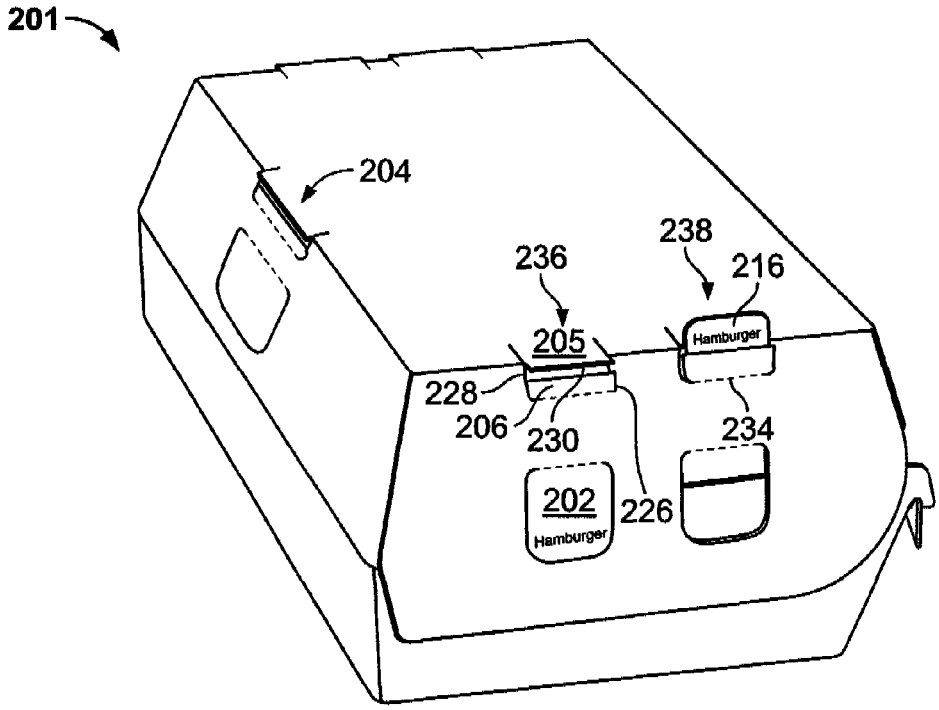
FIG. 5 is a perspective view of a container constructed from the blank shown in FIG. 4.

FIG. 4 is a top plan view of a blank of sheet material 200 for constructing a container 201, according to an alternative embodiment. FIG. 5 is a perspective view of container 201 constructed from blank 200 shown in FIG. 4. As shown in FIG. 4, container 201 includes at least one tab identifier 202 and a corresponding flex member assembly 204. Tab identifiers 202 are similar to tab identifiers 102 and like components are identified with like reference numerals. Flex member assembly 204 includes similar components to the components described above in reference to flex member assembly 104 with like reference numerals. In contrast to bottom edge 116 of tab identifiers 102, bottom edge 216 of tab identifier 202 is defined within lid portion 14. Bottom edge 216 is offset at a distance from edge 224 and is substantially parallel to fold line 74. As shown in FIG. 4, bottom edge 216 is defined within front end panel 66. In this alternative embodiment, tab identifier 202 tapers slightly towards bottom edge 216.

Flex member assembly 204 includes a first flex member 205 and a corresponding second flex member 206 at least partially defined by parallel lines of separation 226 and 228 and slot 230, which is substantially perpendicular to lines of separation 226 and 228. In this embodiment, slot 230 is defined at least partially within front panel 66. In this embodiment, slot 230 is substantially parallel to fold line 74 and positioned at a distance 231 from fold line 74 such that slot 230 is defined within a portion of front end panel 66 of lid portion 214. In an alternative embodiment, slot 230 is substantially collinear with fold line 74. A fold line 232 partially defines an edge 234 of flex member 206. Fold line 232 is substantially parallel to slot 230 and substantially perpendicular to lines of separation 226 and 228. Alternatively or additionally, tab identifiers 102 and corresponding flex member assembly 104 can be defined or formed in other panels of lid portion 214.

In FIG. 5, tab identifier 202 is shown in an initial position 236. Bottom edge 216 is positionable within slot 230 and engages or abuts flex members 205 and 206 to retain tab identifier 202 in display position 238. Flex member 206 extends outwardly with respect to edge 234. Flex member 205 also extends outwardly with respect to top panel 64 and provides additional support to lock tab identifier 102 in display position 238. When tab identifier 202 is in display position 238, a portion of tab identifier 202 extends outwardly with respect to exterior surface 146 of top panel 64. In display position 238, indicia applied to tab identifiers 202 indicate the contents of container 201. For example, the assembler of the food product and/or package may readily designate the contents of the container to thereby inform any intermediate server and/or the consumer of the contents. The intermediate server and/or the consumer knows the contents of the container without opening container 201. Furthermore, tab identifiers 202 in display position 238 allows multiple containers 201 to be stacked with tab identifiers 202 visible.

Figure 7:
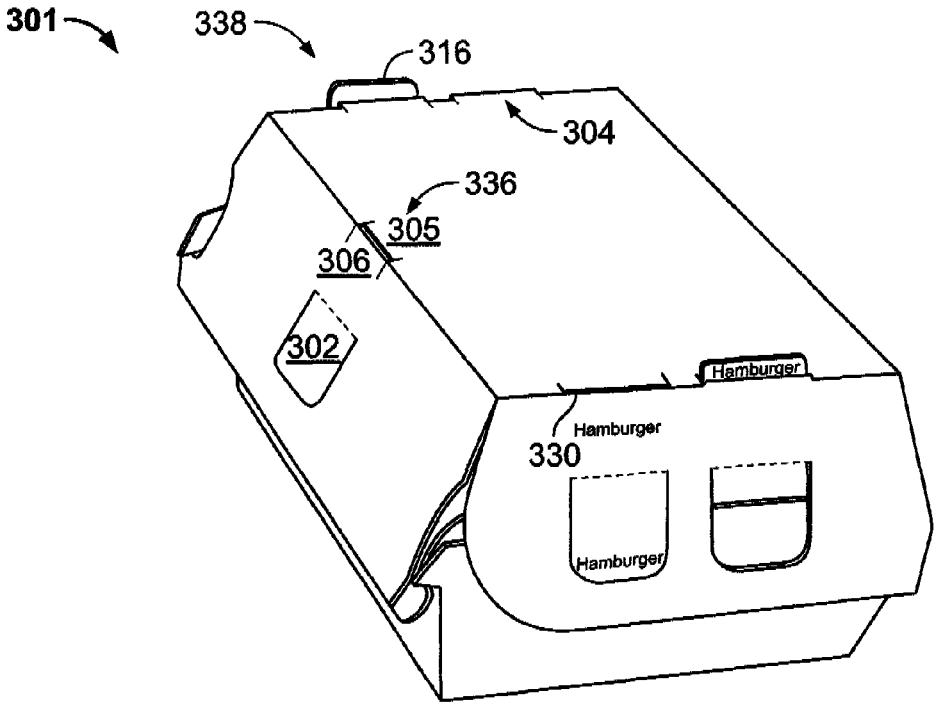
FIG. 7 is a perspective view of a container constructed from the blank shown in FIG. 6.
Figure 6:
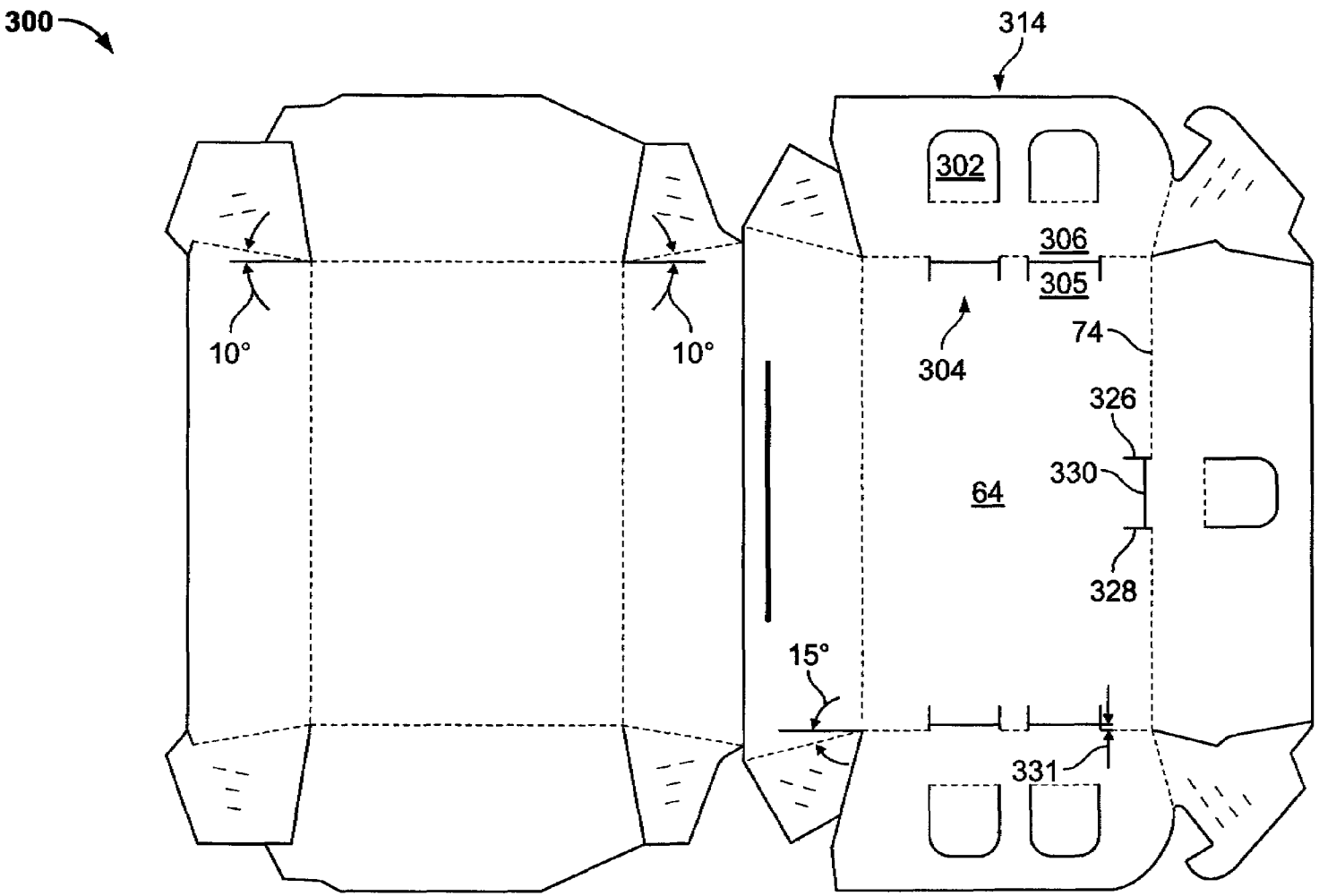
FIG. 6 is a top plan view of a blank of sheet material for constructing a container according to one embodiment.

FIG. 6 is a top plan view of a blank of sheet material 300 for constructing a container 301, according to an alternative embodiment. FIG. 7 is a perspective view of container 301 constructed from blank 300 shown in FIG. 6. As shown in FIG. 6, container 301 includes at least one tab identifier 302 and a corresponding flex member assembly 304. Tab identifiers 302 are similar to tab identifiers 202 and like components are identified with like reference numerals.

FIG. 6 illustrates an alternative flex member assembly 304. In one embodiment, flex member assembly 304 includes a first flex member 305 and a cooperating second flex member 306 at least partially defined by parallel lines of separation 326 and 328 and slot 330, which is substantially perpendicular to lines of separation 326 and 328. In this embodiment, slot 330 is substantially parallel to fold line 74 and positioned at a distance 331 from fold line 74 such that slot 330 is defined within a portion of top panel 64 of lid portion 314. In an alternative embodiment, slot 330 is substantially collinear with fold line 74.

As shown in FIG. 7, several tab identifiers 302 are in an initial position 336. Bottom edge 316 of tab identifier 302 is positionable within slot 330 and engages or abuts flex members 305 and 306 to retain tab identifier 302 in display position 338. When tab identifier 302 is in display position 338, a portion of tab identifier 302 extends outwardly with respect to exterior surface 146 of top panel 64.

Figure 8:
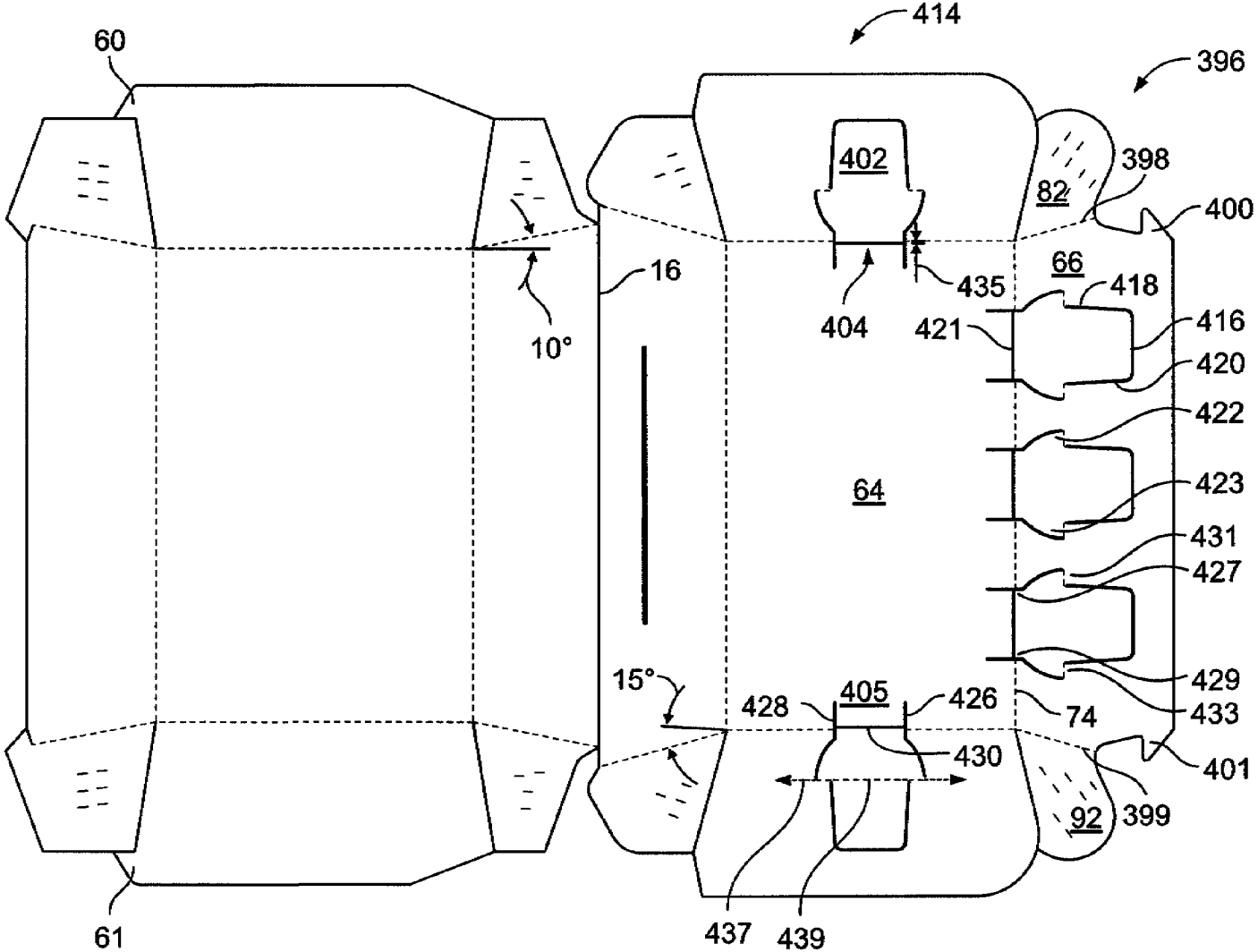
FIG. 8 is a top plan view of a blank of sheet material for constructing a container according to one embodiment.
Figure 9:
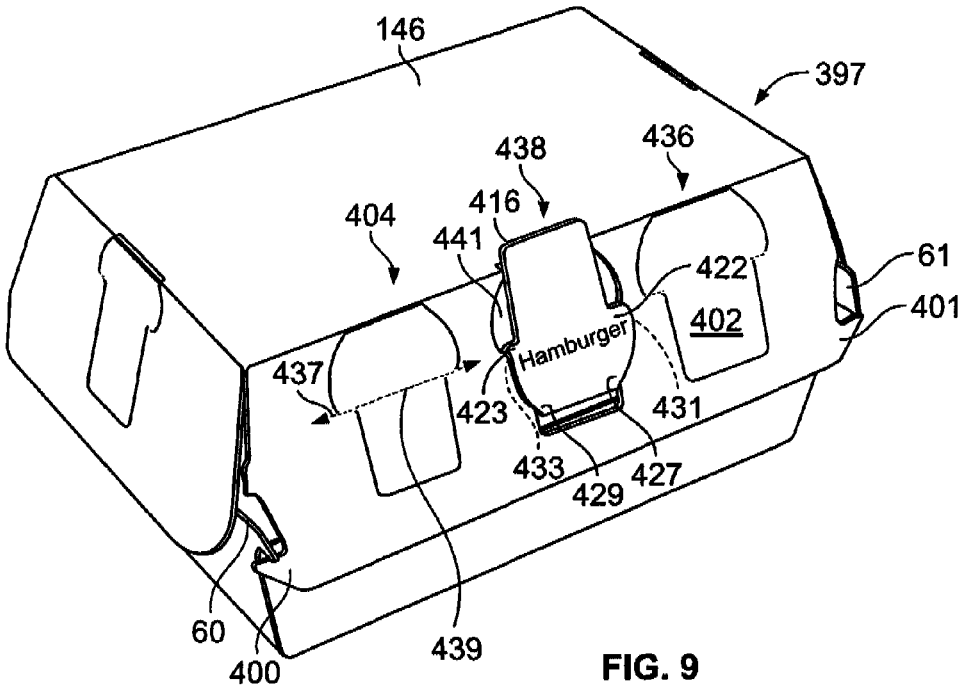
FIG. 9 is a perspective view of a container constructed from the blank shown in FIG. 8.

FIG. 8 is a top plan view of a blank of sheet material 396 for constructing a container 397, according to an alternative embodiment. FIG. 9 is a perspective view of container 397 constructed from blank 396 shown in FIG. 8. As shown in FIG. 8, flaps 82 and 92 are teardrop shaped and positioned adjacent front end panel 66 along fold lines 398 and 399, respectively. Flanges 400 and 401 extend outwardly from front end panel 66. Flanges 400 and 401 couple to tabs 60 and 61, respectively, of constructed container 397 to retain container 397 in the closed configuration as shown in FIG. 9.

In one embodiment, tab identifiers 402 and flex member assembly 404 are integrally formed. In this embodiment, each tab identifier 402 includes a bottom edge 416 and opposing side edges 418 and 420 extending between edge 421 and bottom edge 416. In one embodiment, side edges 418 and 420 are curvilinear. In a particular embodiment, curvilinear side edges 418 and 420 form ribs 422 and 423, respectively. Ribs 422 and 423 extend outwardly from tab identifier 402, as shown in FIG. 8. In a particular embodiment, curvilinear side edges 418 and 420 also form shoulders 427 and 429, respectively. In a particular embodiment, shoulders 427 and 429 extend from ribs 422 and 423, respectively. Central axis 437 extends through tab identifier 402 and along at least a portion of each rib 422 and 423. In one embodiment, fold line 439 extends at least partially along central axis 437 for facilitating rotating tab identifier 402 about central axis 437.

As shown in FIG. 8, in one embodiment flex member assembly 404 includes a first flex member 405 at least partially defined by parallel lines of separation 426 and 428 and slot 430, which is substantially perpendicular to lines of separation 426 and 428. In this embodiment, slot 430 is collinear with fold line 74. In an alternative embodiment, slot 430 is substantially parallel to fold line 74 and positioned a distance from fold line 74.

Each tab identifier 402 rotates about central axis 437. As tab identifier 402 rotates, a void 441 (shown in FIG. 9) is formed. Bottom edge 416 of tab identifier 402 is positioned within the void 441 and engages or abuts flex member assembly 404. In one embodiment, flex member assembly 404 includes a flex member 405 that interferes with bottom edge 416 of tab identifier 402 to retain tab identifier 402 in display position 438 as shown in FIG. 9.

As shown in FIG. 9, flanges 400 and 401 engage tabs 60 and 61, respectively, when lid portion 14 is folded along fold line 16 so as to retain container 397 in the closed configuration. As shown in FIG. 9, several tab identifiers 402 are shown in an initial position 436. In one embodiment, tab identifier 402 is rotated about central axis 437 and engages or cooperates with corresponding flex member assembly 404. In display position 438, tab identifier 402 is positionable within void 441 such that tab identifier 402 engages or abuts flex member 405 to retain tab identifier 402 in display position 438. Ribs 422 and 423 act as hinges positioned along central axis 437. In a particular embodiment, in display position 438, ribs 422 and 423 are positioned such that ribs 422 and 423 abut a portion of front end panel 66, and shoulders 427 and 429 contact or abut flange portions 431 and 433, respectively. In an alternative embodiment, shoulders 427 and 429 are positionable within void 441. Ribs 422 and 423 and shoulders 427 and 429 help retain tab identifier 402 in display position 438.

When tab identifier 402 is in display position 438, a portion of tab identifier 402 extends outwardly with respect to exterior surface 146 of top panel 64. Indicia on tab identifiers 402 in display position 438 is visible from the exterior of container 397 such that contents of container 397 can be identified when container 397 is in the closed configuration. Additionally, tab identifiers 402 provide a suitable surface area for including indicia that indicates or described the contents of container 397. Flex member assembly 404 is configured to flex outwardly to release tab identifier 402 such that tab identifier 402 may be returned to initial position 436.

Figure 11:
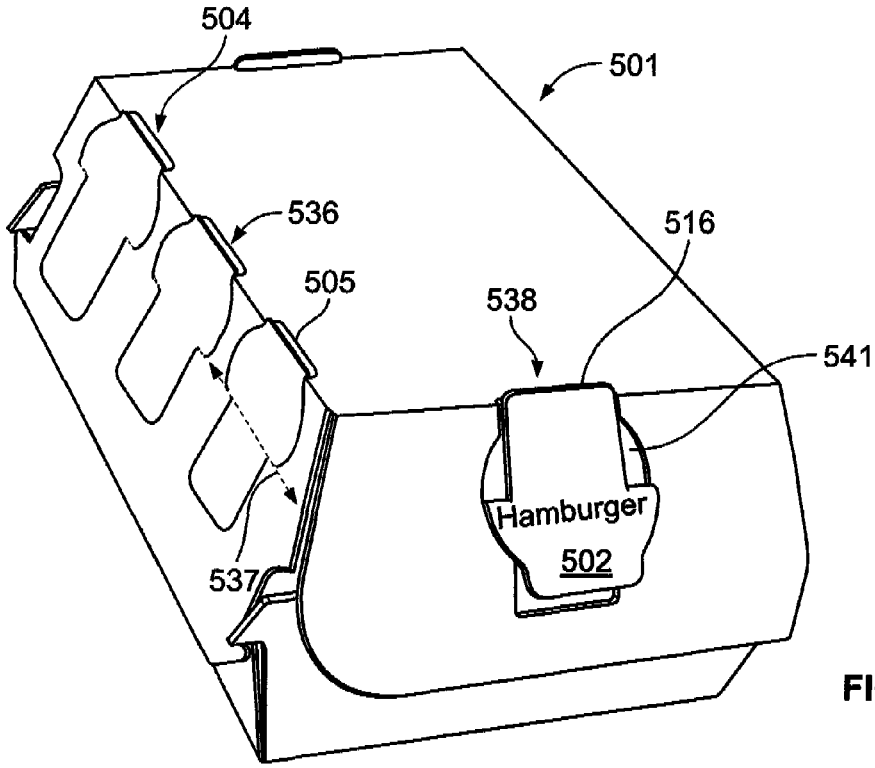
FIG. 11 is a perspective view of a container constructed from the blank shown in FIG. 10.
Figure 10:
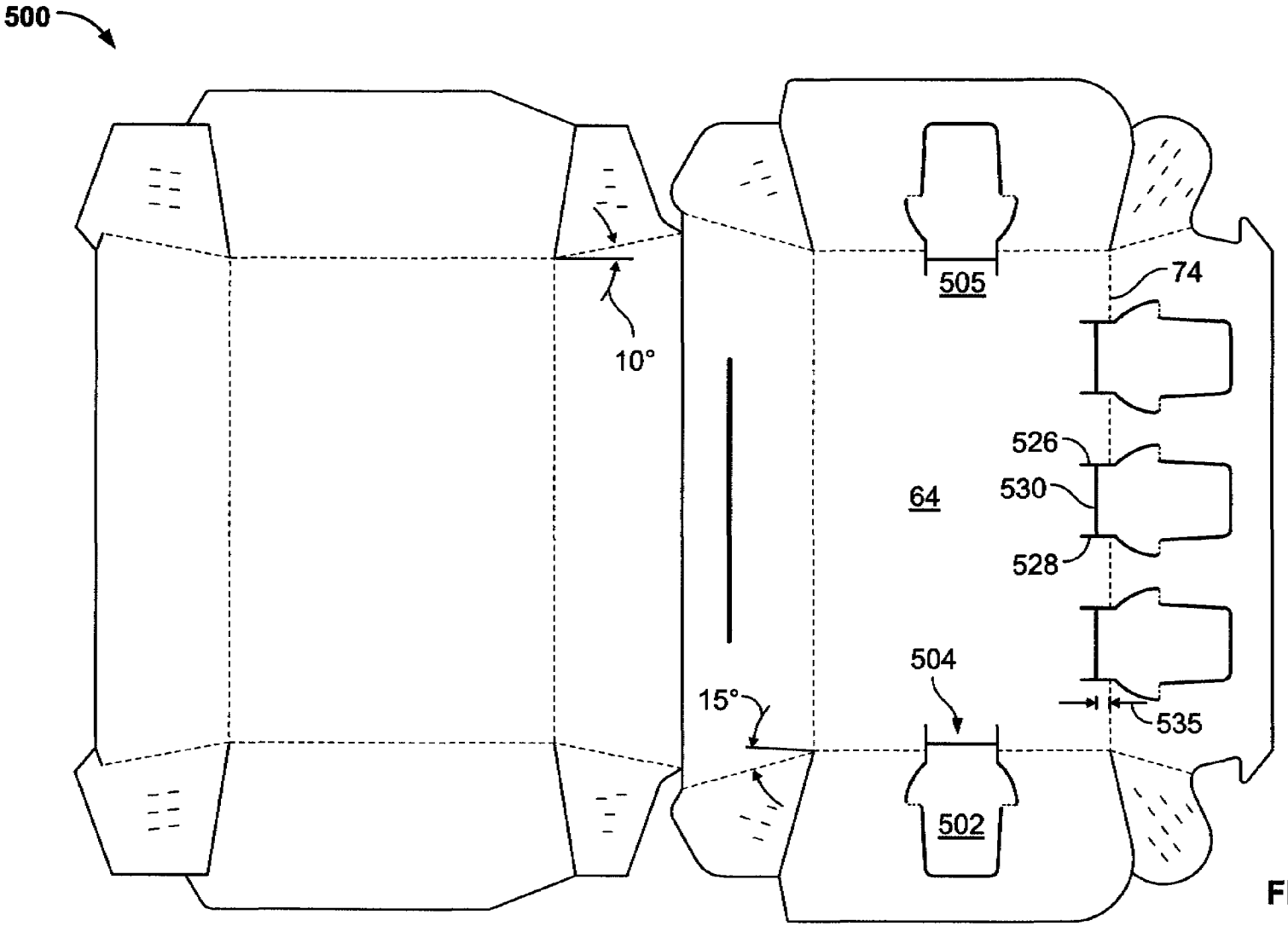
FIG. 10 is a top plan view of a blank of sheet material for constructing a container according to one embodiment.

FIG. 10 is a top plan view of a blank of sheet material 500 for constructing a container 501, according to an alternative embodiment. FIG. 11 is a perspective view of container 501 constructed from blank 500 shown in FIG. 10. As shown in FIG. 10, container 501 includes at least one tab identifier 502 and a corresponding flex member assembly 504. Tab identifiers 502 are similar to tab identifiers 402 and like components are identified with like reference numerals.

FIG. 10 illustrates an alternative flex member assembly 504. In one embodiment, flex member assembly 504 includes a first flex member 505 at least partially defined by parallel lines of separation 526 and 528 and slot 530, which is substantially perpendicular to lines of separation 526 and 528. In this embodiment, slot 530 is substantially parallel to fold line 74 and positioned within top panel 64 at a distance 535 from fold line 74. In an alternative embodiment, slot 530 is collinear with fold line 74.

As shown in FIG. 11, several tab identifiers 502 are in an initial position 536. Bottom edge 516 of tab identifier 502 is positionable within void 541 formed as tab identifier 502 is rotated about central axis 537. In a rotated position, tab identifier 502 engages or abuts flex member 505 to retain tab identifier 502 in display position 538. When tab identifier 502 is in display position 538, a portion of tab identifier 502 extends outwardly with respect to exterior surface 146 of top panel 64. Indicia on tab identifiers 502 in display position 538 is visible from the exterior of container 501 such that contents of container 501 can be identified when container 501 is in the closed configuration. Additionally, the entire interior surface 144 of tab identifier 502 is visible in display position 538 and provides suitable surface area for including indicia that identifies and/or describes the contents of container 501.

Figure 12:
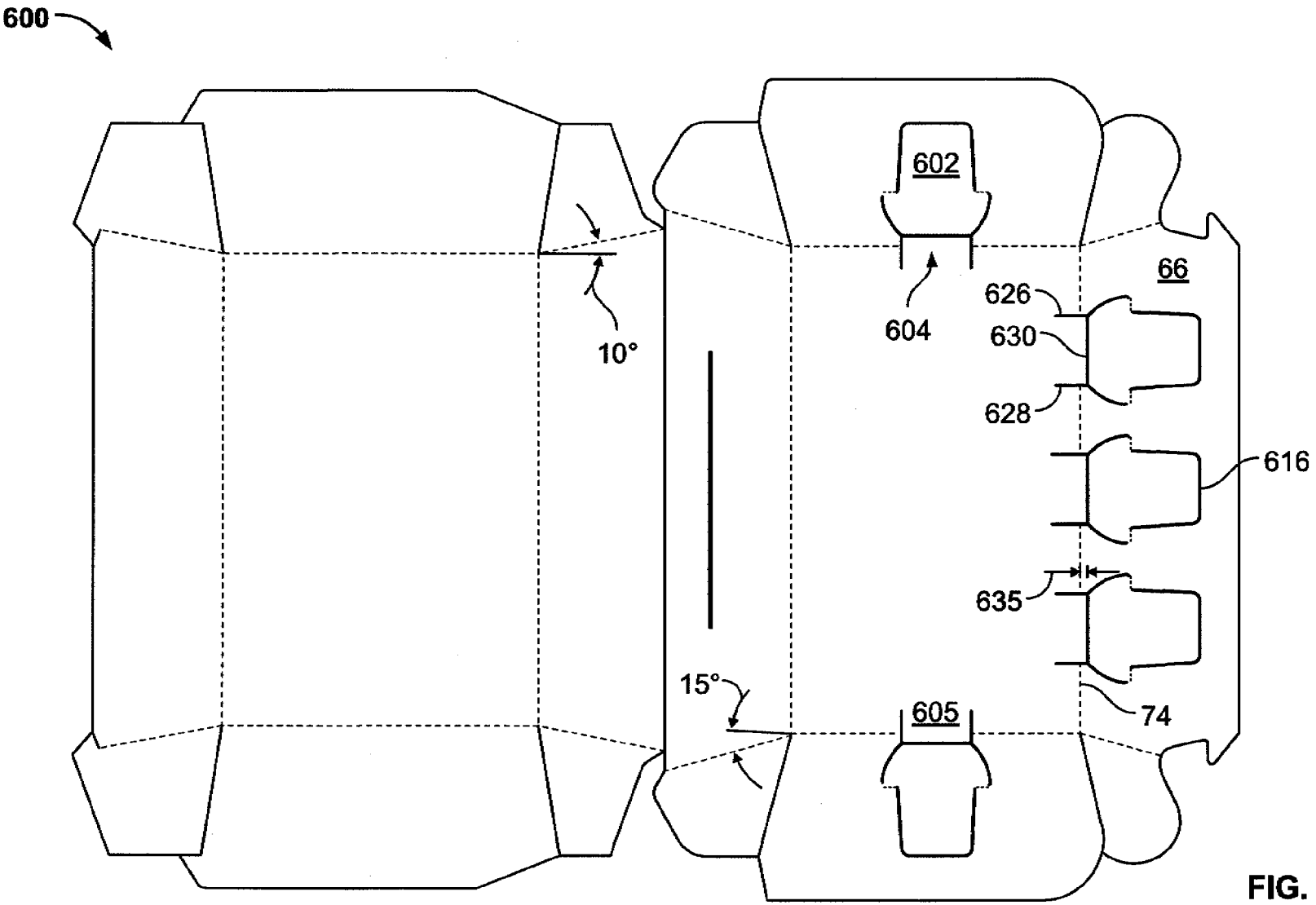
FIG. 12 is a top plan view of a blank of sheet material for constructing a container according to one embodiment.
Figure 13:
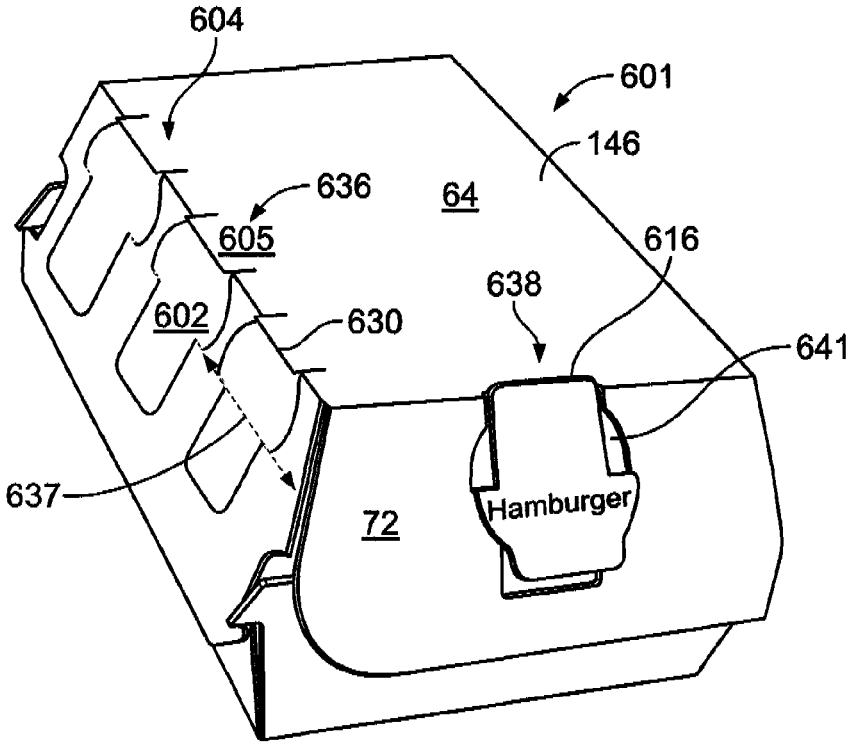
FIG. 13 is a perspective view of a container constructed from the blank shown in FIG. 12.

FIG. 12 is a top plan view of a blank of sheet material 600 for constructing a container 601, according to an alternative embodiment. FIG. 13 is a perspective view of container 601 constructed from blank 600 shown in FIG. 12. a corresponding flex member assembly 604. Tab identifiers 602 are similar to tab identifiers 402 and like components are identified with like reference numerals.

FIG. 12 illustrates an alternative flex member assembly 604. In one embodiment, flex member assembly 604 includes a first flex member 605 at least partially defined by parallel lines of separation 626 and 628 and slot 630, which is substantially perpendicular to lines of separation 626 and 628. In this embodiment, slot 630 is substantially parallel to fold line 74 and positioned within front end panel 66 at a distance 635 from fold line 74. Alternatively, slot 630 is collinear with fold line 74.

As shown in FIG. 13, several tab identifiers 602 are in an initial position 636. Bottom edge 616 of tab identifier 602 is positionable within a void 641 formed as tab identifier 602 is rotated about central axis 637. In a rotated position, tab identifier 602 engages or abuts flex member 605 to retain tab identifier 602 in display position 638. When tab identifier 602 is in display position 638, a portion of tab identifier 602 extends outwardly with respect to exterior surface 146 of top panel 64 and a portion of tab identifier 602 abuts second side panel 72. Similar to the previous embodiment, shown in FIG. 11, the entire interior surface 144 of tab identifier 602 is visible in display position 638 from the exterior surface of container 601 and provides suitable surface area for including indicia that identifies and/or describes the contents of container 601. Additionally, in this embodiment, indicia positioned on exterior surface 146 of tab identifier 602 is visible from the interior of container 601 when container 601 is in open configuration 149 and tab identifier 602 is in display position 638. This allows a user to identify the product to be placed within container 601 without viewing the exterior of container 601 when container 601 is in open configuration 149.

Figure 15:
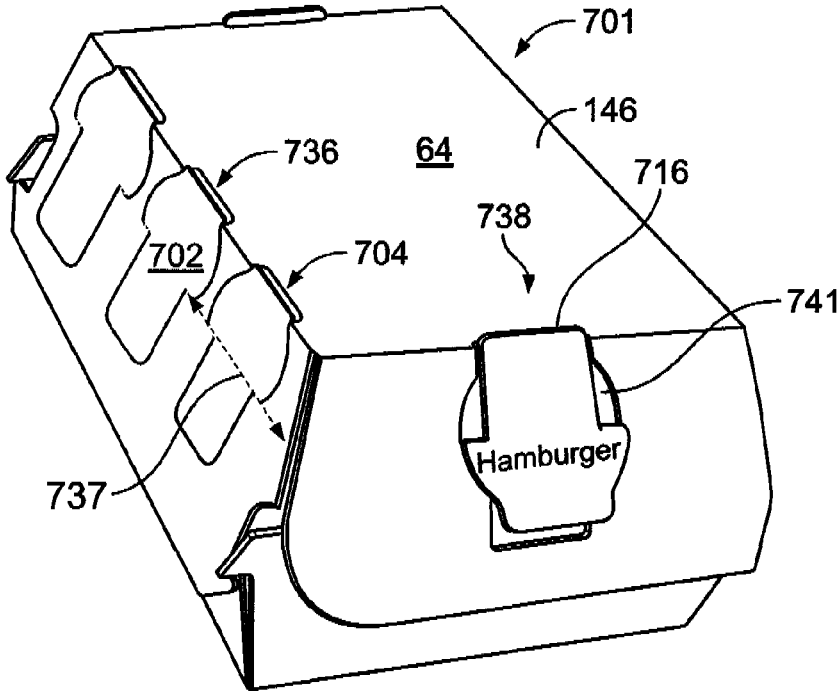
FIG. 15 is a perspective view of a container constructed from the blank shown in FIG. 14.
Figure 14:
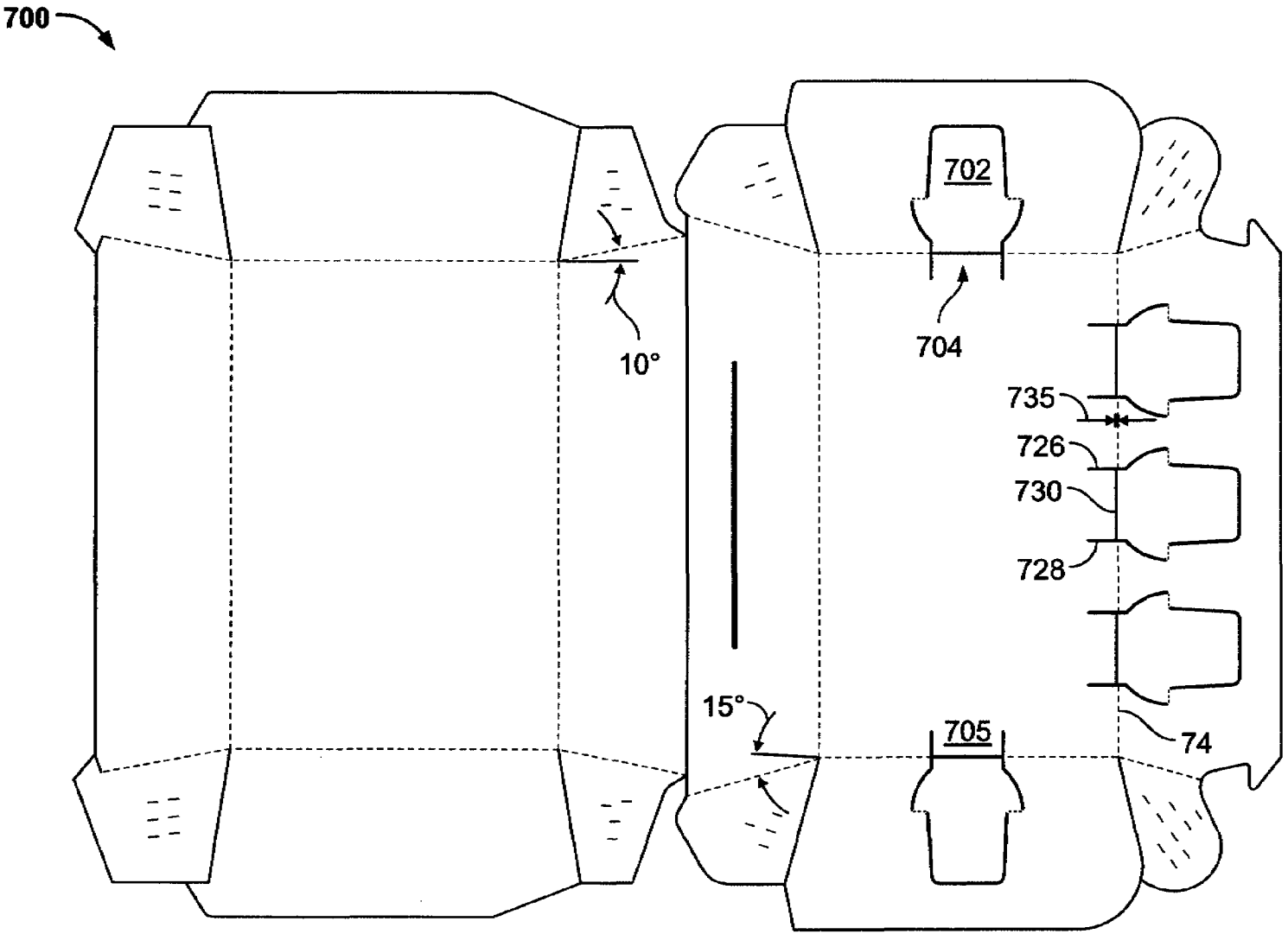
FIG. 14 is a top plan view of a blank of sheet material for constructing a container according to one embodiment.

FIG. 14 is a top plan view of a blank of sheet material 700 for constructing a container 701, according to an alternative embodiment. FIG. 15 is a perspective view of container 701 constructed from blank 700 shown in FIG. 14. As shown in FIG. 14, container 701 includes at least one tab identifier 702 and a corresponding flex member assembly 704. Tab identifiers 702 are similar to tab identifiers 402 and like components are identified with like reference numerals.

FIG. 14 illustrates an alternative flex member assembly 704. In one embodiment, flex member assembly 704 includes a first flex member 705 at least partially defined by parallel lines of separation 726 and 728 and slot 730, which is substantially perpendicular to lines of separation 726 and 728. In this embodiment, slot 730 is substantially parallel to fold line 74 and positioned at a distance 735 from fold line 74. In this embodiment, slot 730 is offset about 1/32 inch with respect to fold line 74.

As shown in FIG. 15, tab identifier 702 is in an initial position 736. Bottom edge 716 of tab identifier 702 is positionable within a void 741 formed as tab identifier 702 is rotated about central axis 737. In a rotated position, tab identifier 702 engages or abuts flex member 705 to retain tab identifier 702 in display position 738. When tab identifier 702 is in display position 738, a portion of tab identifier 702 extends outwardly with respect to exterior surface 146 of top panel 64.

Figure 16:
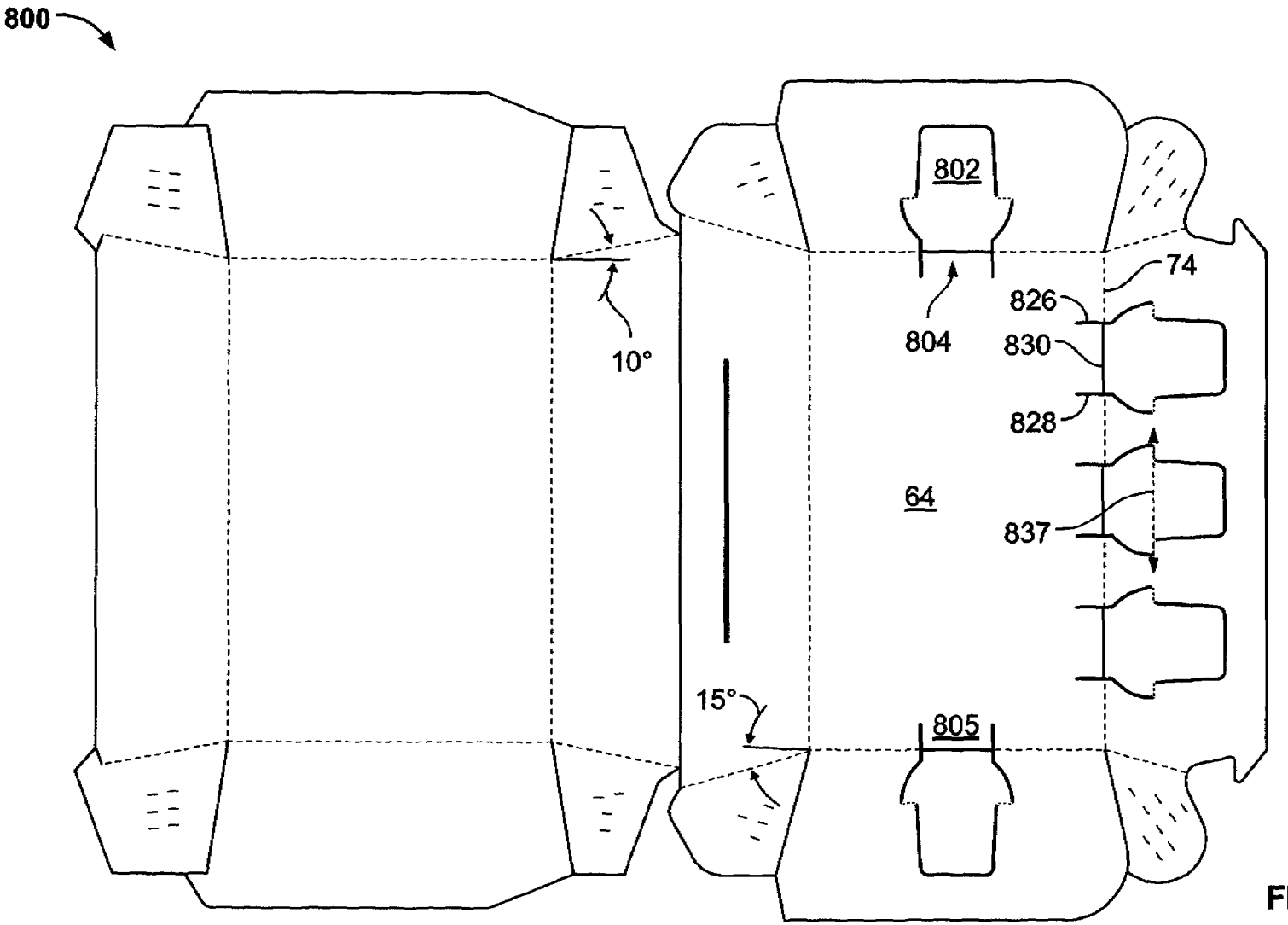
FIG. 16 is a top plan view of a blank of sheet material for constructing a container according to one embodiment.
Figure 17:
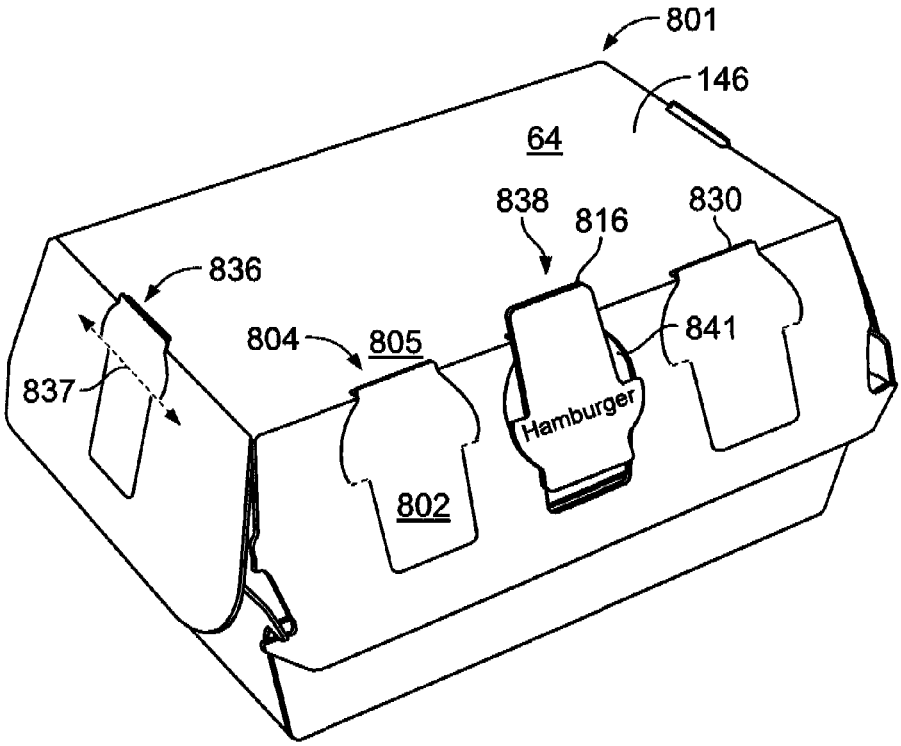
FIG. 17 is a perspective view of a container constructed from the blank shown in FIG. 16.

FIG. 16 is a top plan view of a blank of sheet material 800 for constructing a container 801, according to an alternative embodiment. FIG. 17 is a perspective view of container 801 constructed from blank 800 shown in FIG. 16. As shown in FIG. 16, container 801 includes at least one tab identifier 802 and a corresponding flex member assembly 804. Tab identifiers 802 are similar to tab identifiers 402 and like components are identified with like reference numerals.

FIG. 16 illustrates an alternative flex member assembly 804. In one embodiment, flex member assembly 804 includes a first flex member 805 at least partially defined by parallel lines of separation 826 and 828 and slot 830, which is substantially perpendicular to lines of separation 826 and 828. In this embodiment, slot 830 is substantially parallel to fold line 74. In this embodiment, slot 830 is offset about 0.02 inch with respect to fold line 74.

As shown in FIG. 17, several tab identifiers 802 are in an initial position 836. Bottom edge 816 of tab identifier 802 is positionable within void 841 formed as tab identifier 802 is rotated about central axis 837. In a rotated position, tab identifier 802 engages or abuts flex member 805 to retain tab identifier 802 in display position 838. When tab identifier 802 is in display position 838, a portion of tab identifier 802 extends outwardly with respect to exterior surface 146 of top panel 64.

Tab identifier 802 is manually engaged and locked within lid portion 14 by rotating or pivoting tab identifier 802 about central axis 837. Once in the locked or display position, tab identifier 802 provides an exterior identification and an interior identification of the food product. Line crews have the ability to identify the food product from the interior identification to direct the line crew members to load and build the food item, as requested by the consumer. The exterior identification allows the server to accurately deliver the food product to the consumer while reducing server error.

Figure 19:
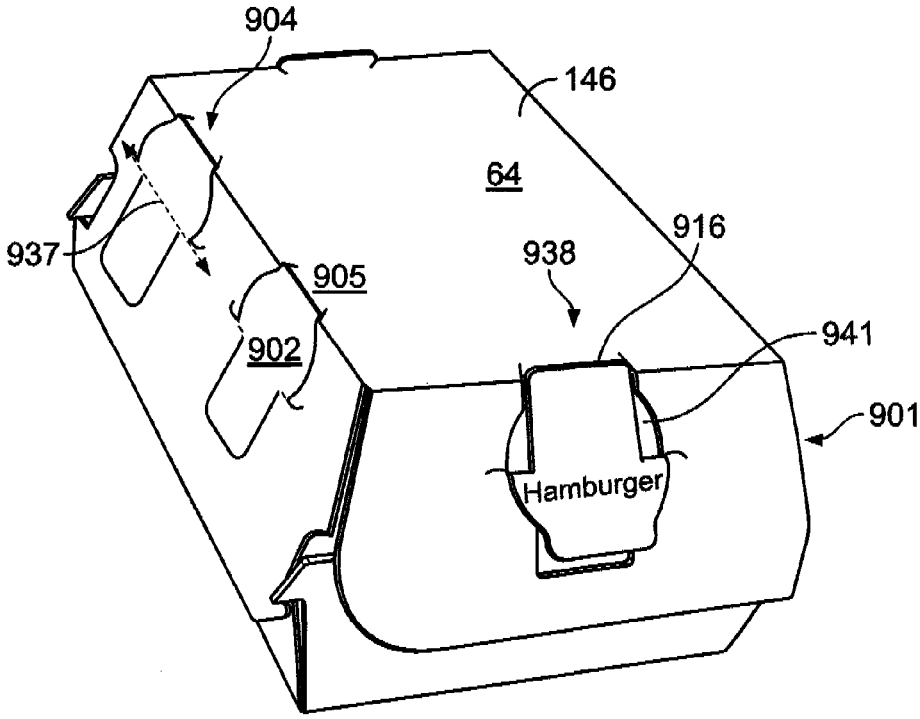
FIG. 19 is a perspective view of a container constructed from the blank shown in FIG. 18.
Figure 18:
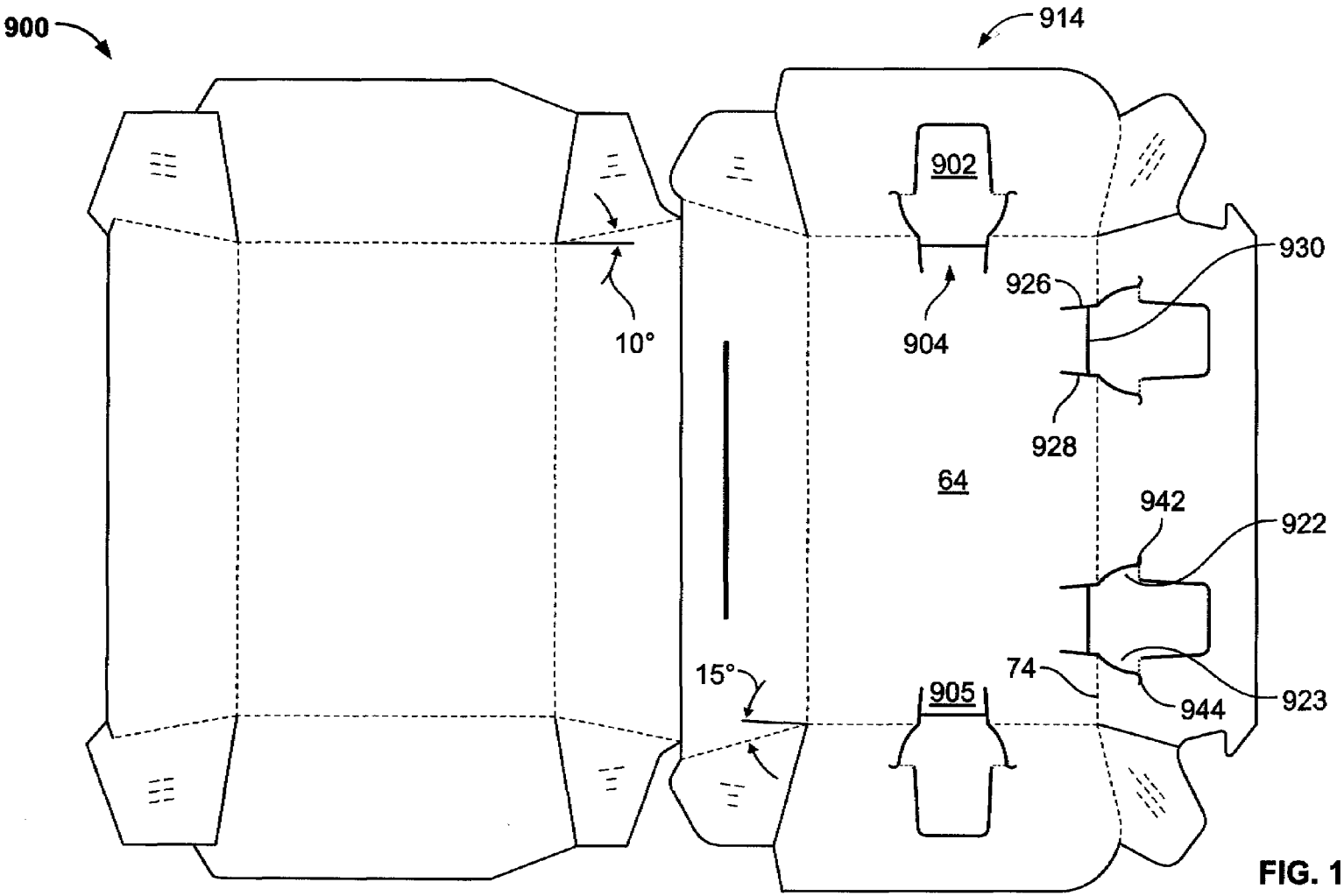
FIG. 18 is a top plan view of a blank of sheet material for constructing a container according to one embodiment.

FIG. 18 is a top plan view of a blank of sheet material 900 according to an alternative embodiment. FIG. 19 is a perspective view of container 901 constructed from blank 900 shown in FIG. 18. As shown in FIG. 18, blank of sheet material 900 includes at least one tab identifier 902 and a corresponding flex member assembly 904. Tab identifiers 902 are similar to tab identifiers 402 and like components are identified with like reference numerals.

FIG. 18 illustrates an alternative tab identifier 902 such that ribs 922 and 923 each include hook-shaped slits 942 and 944 extending outwardly from ribs 922 and 923, respectively. Slits 942 and 944 are configured to prevent users from tearing any portion of lid portion 914 when rotating tab identifiers 902. Additionally, FIG. 18 illustrates an alternative flex member assembly 904. In this embodiment, edges 926 and 928 are angled inwardly in top panel 64 of lid portion 914.

As shown in FIG. 19, several tab identifiers 902 are in an initial position 936. Bottom edge 916 of tab identifier 902 is positionable within void 941 formed as tab identifier 902 is rotated about central axis 937. In a rotated position, tab identifier 902 engages or abuts flex member 905 to retain tab identifier 902 in display position 938. When tab identifier 902 is in display position 938, a portion of tab identifier 902 extends outwardly with respect to exterior surface 146 of top panel 64.

Figure 20:
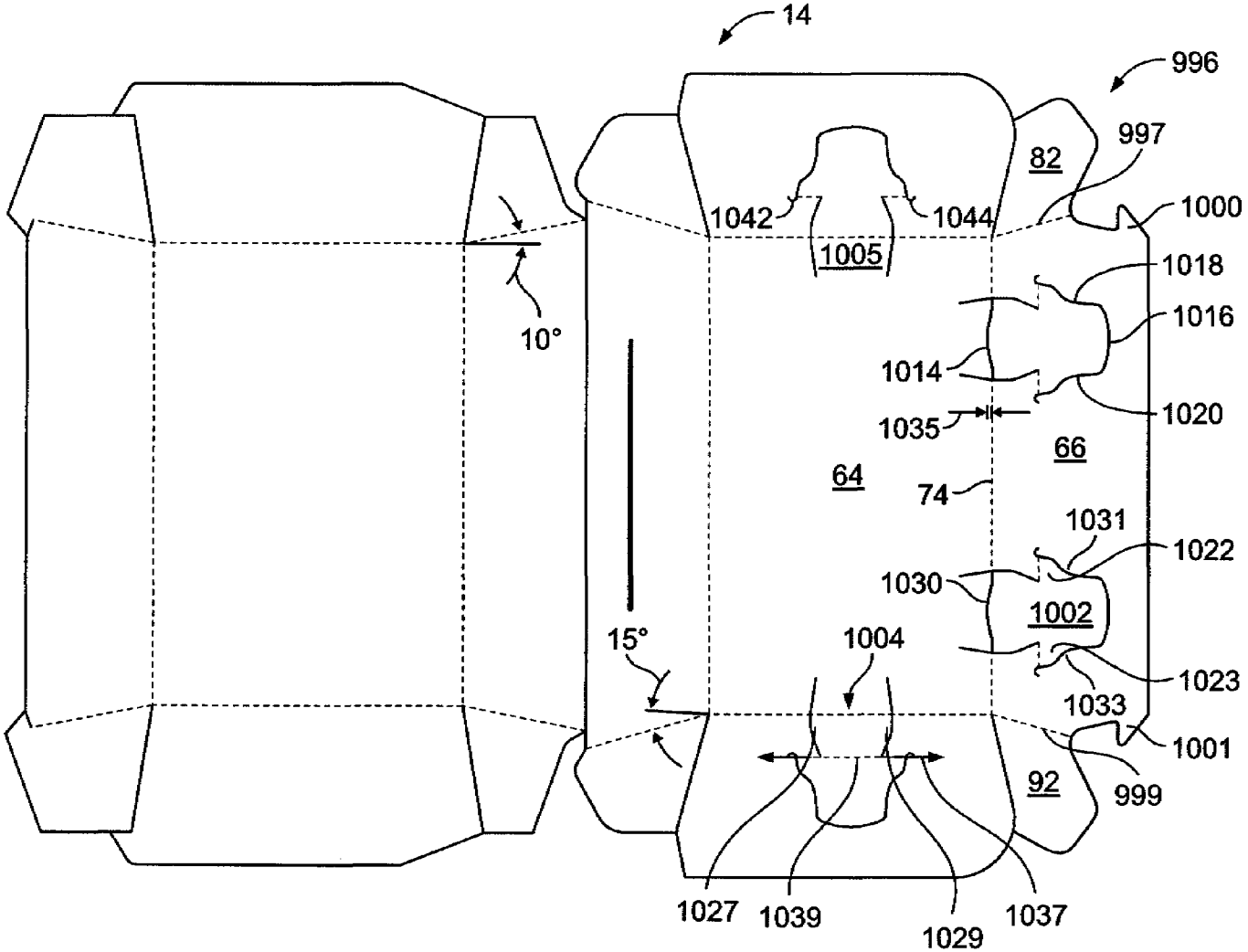
FIG. 20 is a top plan view of a blank of sheet material for constructing a container according to one embodiment.
Figure 21:
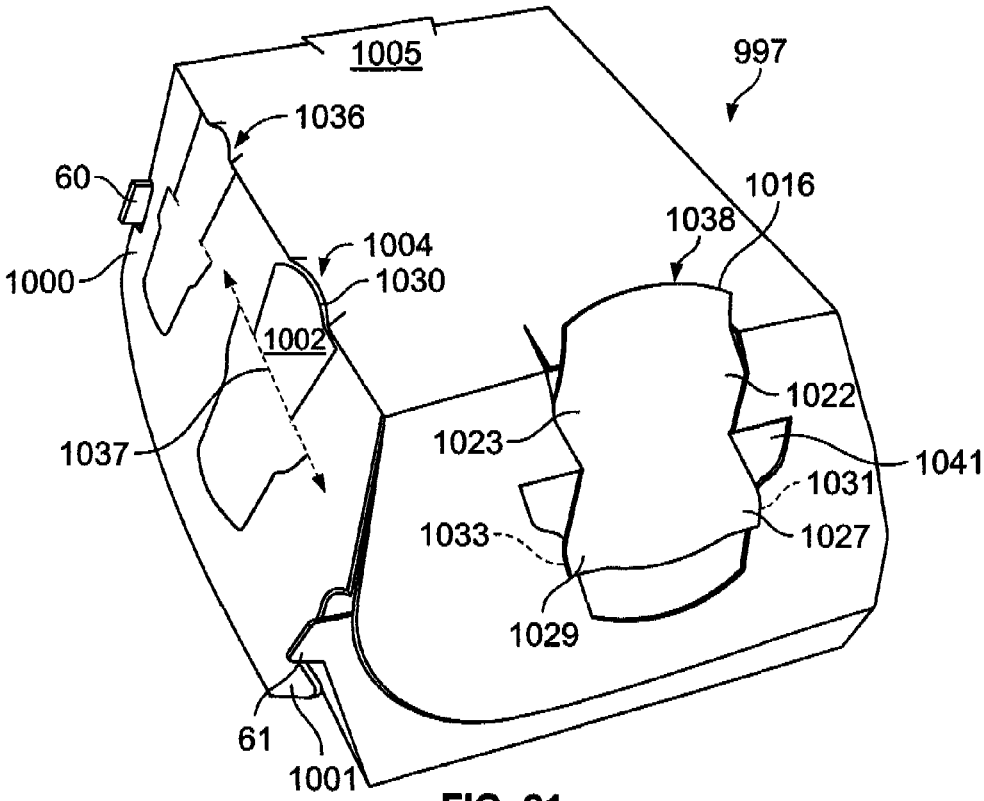
FIG. 21 is a perspective view of a container constructed from the blank shown in FIG. 20.

FIG. 20 is a top plan view of a blank of sheet material 996 for constructing a container 998, according to an alternative embodiment. FIG. 21 is a perspective view of container 998 constructed from blank 996 shown in FIG. 20. As shown in FIG. 20, flaps 82 and 92 are teardrop shaped and positioned adjacent front end panel 66 along fold lines 997 and 999, respectively. Flanges 1000 and 1001 extend outwardly from front end panel 66. Flanges 1000 and 1001 couple to tabs 60 and 61, respectively, of constructed container 998 to retain container 998 in the closed configuration as shown in FIG. 21.

In one embodiment, tab identifiers 1002 and flex member assembly 1004 are integrally formed. In this embodiment, each tab identifier 1002 includes a top edge 1014, a bottom edge 1016 and opposing side edges 1018 and 1020. In one embodiment, top edge 1014 and bottom edge 1016 are curvilinear. In one embodiment, side edges 1018 and 1020 are curvilinear. In a particular embodiment, curvilinear side edges 1018 and 1020 form ribs 1022 and 1023, respectively. Ribs 1022 and 1023 extend outwardly from tab identifier 1002 and act as hinges. Central axis 1037 extends through tab identifier 1002 and along at least a portion of each rib 1022 and 1023. In one embodiment, fold line 1039 extends at least partially along central axis 1037 for facilitating rotating tab identifier 1002 about central axis 1037. In a particular embodiment, curvilinear side edges 1018 and 1020 also form shoulders 1027 and 1029, respectively, and extend from ribs 1022 and 1023. In a particular embodiment, ribs 1022 and 1023 each include hook-shaped slits 1042 and 1044 extending outwardly from ribs 1022 and 1023, respectively. Slits 1042 and 1044 are configured to prevent users from tearing any portion of lid portion 14 when rotating tab identifiers 1002.

In one embodiment, flex member assembly 1004 includes a first flex member 1005 at least partially defined by parallel lines of separation 1026 and 1028 and slot 1030, which is substantially perpendicular to lines of separation 1026 and 1028. In this embodiment, edges 1026 and 1028 are angled inwardly in top panel 64 of lid portion 1014. In this embodiment, slot 1030 is curvilinear and extends generally along fold line 74. In an alternative embodiment, slot 1030 is positioned at a distance 1035 from fold line 74.

As shown in FIG. 21, flanges 1000 and 1001 engage tabs 60 and 61, respectively, when lid portion 14 is folded along fold line 16 so as to retain container 998 in a closed configuration. As shown in FIG. 21, several tab identifiers 1002 are shown in an initial position 1036. In one embodiment, tab identifiers 1002 are rotated about fold line 1039 and engages or abuts corresponding flex member assembly 1004 such that tab identifier 1002 is in a display position 1038. Void 1041 is formed as tab identifier 1002 is rotated about central axis 1037. In one embodiment, when tab identifier 1002 is in display position 1038, flex member 1005 extends outwardly from lid portion 14 to retain tab identifier 1002. In display position 1038, ribs 1022 and 1023 are positioned such that ribs 1022 and 1023 abut a portion of front end panel 66 and shoulders 1027 and 1029 contact, engage, or abut flange portions 1031 and 1033, respectively. In an alternative embodiment, shoulders 1027 and 1029 are positioned within void 1041. Ribs and shoulders 1027 and 1029 help retain tab identifier 1002 in display position 1038. Furthermore, flex member assembly 1004 is configured to flex outwardly to release tab identifier 1002 such that tab identifier 1002 may be returned to a general initial position 1036 within void 1041. In this embodiment, tab identifier 1002 includes indicia positioned at or near bottom edge 116 on interior surface 144 and/or exterior surface 146 of tab identifier 102.

As shown in FIG. 21, tab identifier 1002 in display position 1038 provides a suitable surface area for including indicia that identifies and/or describes the contents within container 998. Also, containers 998 with tab identifiers 1002 in display position 1038 are stackable. Additionally, in this embodiment, indicia positioned on exterior surface 146 of tab identifier 1002 is visible from the interior of container 998 when container 998 is in open configuration 149 and tab identifier 1002 is in display position 1038. This allows a user to identify the product to be placed within container 998 without viewing the exterior of container 998 when container 998 is in open configuration 149.

Figure 23:
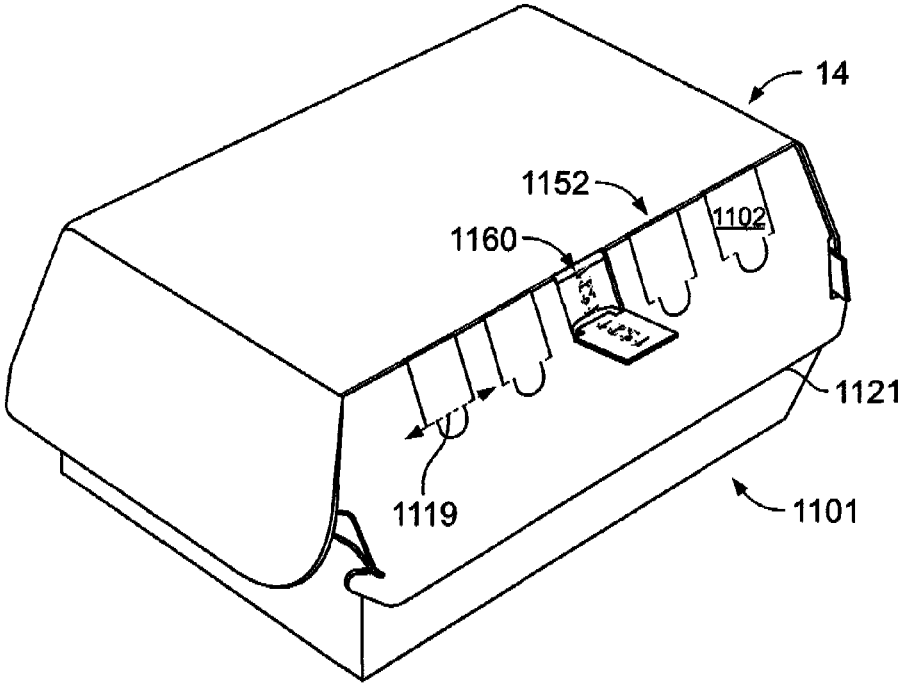
FIG. 23 is a perspective view of a container constructed from the blank shown in FIG. 22.
Figure 22:
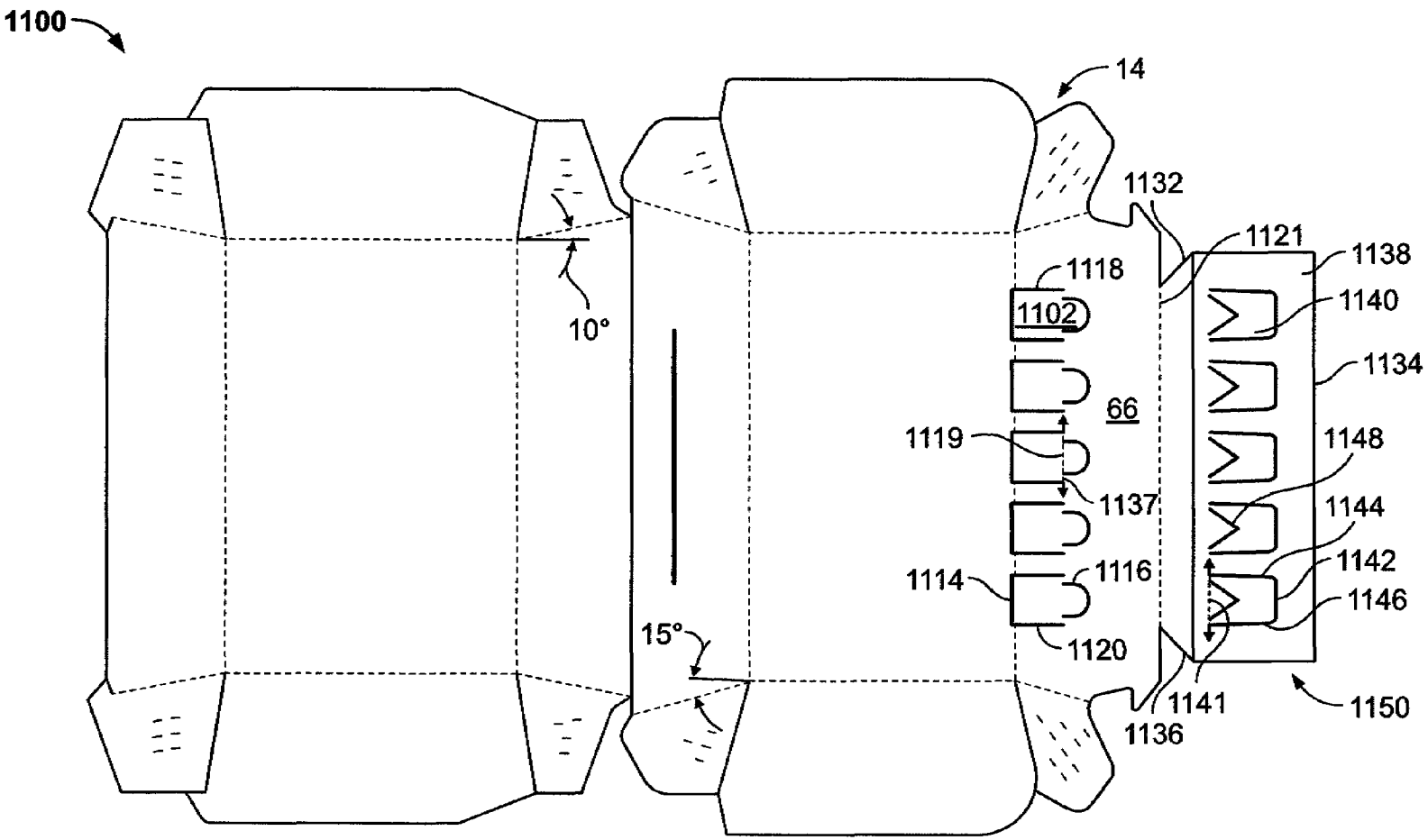
FIG. 22 is a top plan view of a blank of sheet material for constructing a container according to one embodiment.

FIG. 22 is a top plan view of a blank of sheet material 1100 for constructing a container 1101, according to an alternative embodiment. FIG. 23 is a perspective view of container 1101 constructed from blank 1100 shown in FIG. 22. Tab identifiers 1102 are oriented within front end panel 66, rear end panel 68, side panel 70 and/or side panel 72 of lid portion 14. Specifically, each tab identifier 1102 includes a top edge 1114, an opposing bottom edge 1116 and opposing side edges 1118 and 1120 extending between top edge 1114 and bottom edge 1116. In a particular embodiment, edges 1118 and 1120 are substantially parallel and edge and 1114 is substantially perpendicular to edges 1118 and 1120. In a particular embodiment, edge 1116 is defined within front end panel 66 and is curvilinear. A hinge line 1119 is defined within front end panel 66 extending between edges 1118 and 1120. Suitable lines of separation, such as perforated lines, are defined along edges 1114, 1118, and 1120.

In one embodiment, container 1101 includes edges 1132, 1134, 1136 defining second front end panel 1150. Second front end panel 1150 includes an interior surface (not shown) and an exterior surface 1138. In one embodiment, interior surface and exterior surface 1138 may include indicia. Second front end panel 1150 shares a common edge 1121 with front end panel 66 such that second front end panel 1150 extends outwardly from front end panel 66 along edge 1121. A fold line is defined along edge 1121 such that second front end panel 1150 is configured to fold towards the interior surface of container 1101. In one embodiment, second front end panel 1150 is coupled to the interior surface of panel 66. A portion of each edge 1132 and 1136 are angled to prevent second front end panel 1150 from interfering with assembly of container 1101.

A plurality of segments 1140 are defined within second front end 1150. Segments 1140 are defined by edges 1142, 1144, 1146 and 1148. Edge 1142 is substantially parallel to edge 1121 and substantially perpendicular to edges 1144 and 1146. Edge 1148 is defined between edges 1144 and 1146. In one embodiment, edge 1148 is v-shaped. In one embodiment, edges 1142, 1144, and 1146 are suitable lines of separation. In one embodiment, segments 1140 include indicia on exterior surface 1138 and/or on an interior surface (not shown).

As shown in FIG. 23, second front end panel 1150 is rotated about edge 1121 towards the interior surface 144 of panel 66 and coupled to panel 66. In an alternative embodiment, edge 1148 is positionable within edge 1116 to assist in coupling second front end panel 1150 to panel 66 wherein at least a portion of edge 1116 forms a line of separation. With second front end panel 1150 coupled to panel 66, edges 1148 and 1116 are substantially aligned. Several tab identifiers 1102 are shown in an initial position 1152. A fold line 1137 defined at least partially along hinge line 1119. In one embodiment, tab identifier 1102 is configured to be pulled outwardly, rotating along fold line 1137 to an extended position 1160. In a particular embodiment, edge 1114 of tab identifier 1102 extends outward from panel 64 of lid portion 14 such that a user may easily move tab identifier 1102 from an initial position 1152 to an extended position 1160. In one embodiment, with tab identifier 1102 in extended position 1160, indicia on interior surface of segment 1140 is visible, and indicia on tab identifier 1102 is also visible. In one embodiment, segments 1140 are rotated outwardly along a fold line 1141 towards interior surface 144 of container 1101 allowing users to view indicia when container 1101 is in open configuration 149. Tab identifier 1102 provides a useful and practical alternative to tab identifiers described above. When tab identifiers 1102 are in display position 1160, indicia is visible on two or more portions of lid portion 14. Furthermore, containers 1101 with tab identifiers 1102 in display 1160 are stackable.

While the invention has been described in terms of various specific embodiments, those skilled in the art will recognize that the invention can be practiced with modification within the spirit and scope of the claims.

What is claimed is:

1. A container for packaging a product, the container formed from a blank sheet of material and comprising:

a tray portion; and a lid portion foldably connected to the tray portion and comprising a top panel, an end panel foldably connected to the top panel, a first tab identifier defined within the end panel, and a flex member assembly defined in at least one of the end panel and the top panel;

wherein the lid portion is moveable with respect to the tray portion between an open configuration and a closed configuration, the tray portion and the lid portion defining a volume for storing the product when the lid portion is in the closed position, wherein the first tab identifier is configured to be folded along a fold line into the flex member assembly to extend outwardly from the container, the fold line being spaced from the top panel, wherein the flex member assembly defines a first member, an opposing second member, and a slot extending between the first member and the second member, and wherein the end panel further comprises a top edge, the slot being offset a distance with respect to the top edge.

2. The container of claim 1 wherein the first tab identifier comprises a top edge along which the fold line is defined, an opposing bottom edge, opposing side edges, and a line of separation defined along each of the opposing side edges, the first tab identifier being configured to move about the top edge of the first tab identifier with respect to the end panel.

3. The container of claim 2 wherein the top edge of the first tab identifier is substantially parallel to the bottom edge, and the opposing side edges are substantially parallel with respect to one another.

4. The container of claim 2 wherein each of the opposing side edges is substantially perpendicular to the top edge of the first tab identifier and the bottom edge.

5. The container of claim 2 wherein the first tab identifier is substantially rectangular in shape.

6. The container of claim 2 wherein at least one of the top edge of the first tab identifier, the bottom edge, and the opposing side edges is substantially curvilinear.

7. The container of claim 1 wherein the first tab identifier comprises a top edge, the top edge of the first tab identifier being positioned at a distance from the slot.

8. The container of claim 1 wherein the first member is defined at least partially within the end panel and the second member is defined at least partially within the top panel.

9. The container of claim 1 wherein the first tab identifier comprises a top edge along which the fold line is defined, the first tab identifier being moveable about the fold line and positionable within the slot in a display position.

10. The container of claim 9 wherein the first tab identifier further comprises indicia printed on at least one of an interior surface and an exterior surface, the indicia being visible in the display position.

11. The container of claim 1 wherein the lid portion further comprises indicia applied to at least one of an interior surface and an exterior surface of the lid portion.

12. The container of claim 1 wherein the container further comprises a second tab identifier, the second tab identifier being defined within the lid portion.

13. The container of claim 12 wherein the first tab identifier is configured to contact the second tab identifier, the first tab identifier and the second tab identifier being configured to move independently.

14. The container of claim 12 wherein the second tab identifier is positionable within a second flex member assembly defined by the lid portion.

15. The container of claim 1 wherein the flex member assembly is not configured to be removable from the container.

* * * * *